US005559524A

United States Patent [19]

Takei et al.

[11] Patent Number: 5,559,524

[45] Date of Patent: Sep. 24, 1996

[54] ANTENNA SYSTEM INCLUDING A PLURALITY OF MEANDER CONDUCTORS FOR A PORTABLE RADIO APPARATUS

[75] Inventors: Ken Takei; Masami Ohnishi, both of Hachioji; Mikio Kuwahara, Kokubunji, all of Japan

[73] Assignee: Hitachi, Ltd., Tokyo, Japan

[21] Appl. No.: 207,428

[22] Filed: Mar. 8, 1994

Related U.S. Application Data

[63] Continuation-in-part of Ser. No. 834,350, Feb. 12, 1992, Pat. No. 5,298,910, and Ser. No. 24,459, Mar. 1, 1993, abandoned.

[30] Foreign Application Priority Data

| | | | |
|---|---|---|---|
| Mar. 18, 1991 | [JP] | Japan | 3-052191 |
| Feb. 28, 1992 | [JP] | Japan | 4-042836 |
| Mar. 27, 1992 | [JP] | Japan | 4-070596 |

[51] Int. Cl.[6] ..... H01Q 1/36; H01Q 1/08

[52] U.S. Cl. ..... 343/895; 343/873; 343/872

[58] Field of Search ..... 343/895, 806, 343/873, 731, 867, 872; H01Q 1/36, 11/02, 11/14, 11/08, 21/00

[56] References Cited

U.S. PATENT DOCUMENTS

| | | | |
|---|---|---|---|
| 3,523,251 | 8/1970 | Halstead | 343/895 |
| 4,148,030 | 4/1979 | Foldes | 343/895 |
| 4,987,424 | 1/1991 | Tamura et al. | 343/795 |
| 5,134,422 | 7/1992 | Auriol | 343/895 |
| 5,298,910 | 3/1994 | Takei et al. | 343/749 |

FOREIGN PATENT DOCUMENTS

| | | | |
|---|---|---|---|
| 2077046 | 12/1981 | United Kingdom | 343/895 |

*Primary Examiner*—Hoanganh Le

*Attorney, Agent, or Firm*—Antonelli, Terry, Stout & Kraus

[57] ABSTRACT

An antenna of small size is provided which can be mass-produced, which is suitable for use with a portable receiver and which does not require provision of a separate matching circuit. The antenna includes a plurality of meander antennas printed on at least one dielectric film and satisfying respectively different resonance conditions in a frequency band used by the receiver, at least one dielectric solid cylinder for winding the dielectric film therearound, and a dielectric hollow cylinder for covering the dielectric film wound around the dielectric solid cylinder. The individual meander antennas printed on the dielectric film do not make direct electrical contact with each other, and one of the meander antennas connected to a feeder or a helical antenna surrounding the dielectric solid cylinder acts to produce multiple resonance by means of electromagnetic coupling with the other meander antennas, thereby widening the frequency band. The dielectric solid cylinder around which the dielectric film is wound or to which the dielectric film is bonded may be replaced by a dielectric polygonal prism such as a dielectric square prism. In the antenna, impedance matching with the radio frequency part of the receiver can be satisfactorily achieved, so that an antenna of low cost suitable for portable receivers can be offered.

11 Claims, 36 Drawing Sheets a-b: BAND REQUIRED BY SYSTEM

ANTENNA SYSTEM INCLUDING A PLURALITY OF MEANDER CONDUCTORS FOR A PORTABLE RADIO APPARATUS

CROSS REFERENCE TO RELATED APPLICATIONS

This application is a continuation-in-part application of Ser. No. 834,350 filed Feb. 12, 1992, now U.S. Pat. No. 5,298,910 and Ser. No. 024,459 filed Mar. 1, 1993, now abandoned.

BACKGROUND OF THE INVENTION

The present invention relates to an antenna for radio apparatus, and more particularly to a compact antenna used for a compact portable terminal which occupies only a small volume, such as a portable mobile terminal. The invention also relates to an antenna of small size applied to a portable receiver or the like, and more particularly to an antenna of small size preferably applied to a portable receiver of small size because of its high mass productivity and its wide frequency band.

An inverted F type antenna or a helical antenna has hitherto been employed for compact portable terminals occupying a small volume, such as portable mobile terminals. In either type of antenna, when the antenna volume is decreased as the miniaturization of the terminal advances, impedance matching problems with the radio frequency section of the receiver become inevitable, and a capacitance component larger than a radiation resistance component takes place. In order to cancel this large capacitance component, the conventional antenna needs a matching circuit provided separately from the antenna proper. An example of such a conventional antenna is disclosed in, for example, JP-B-2-22563.

In the conventional antenna, characteristics of the antenna having the antenna proper and the matching circuit in combination have to be studied, and, from a standpoint of occupied volume, the matching circuit forms a factor which limits the miniaturization. Further, the matching circuit is realized with lumped constant elements (inductors and capacitances) or transmission lines, and upon incorporation of the antenna into the terminal, these elements must also be incorporated thereinto, thus considerably raising cost.

On the other hand, the frequency band can be widened by constructing such a matching circuit to be as simple as possible. In a known extreme case intended for widening the frequency band, the aforementioned matching circuit is not provided. Instead, a plurality of helical antennas having respectively different electric lengths are provided without making any electrical contact with each other. This causes multiple resonance owing to electromagnetic coupling of the helical antennas, so that the substantial frequency band of the helical antenna connected to a feeder can be widened.

An example of the latter case is described in detail in U.S. Pat. No. 4,772,895.

SUMMARY OF THE INVENTION

A first object of the invention is to provide a compact antenna which can obtain a desired matching characteristic without using the separate matching circuit which limits miniaturization of the antenna system as a whole and which forms a factor of raising cost when the antenna is incorporated into the terminal.

To accomplish the above first object, according to one aspect of the present invention, an antenna comprises a first conductor taking a helical form, a second conductor which extends to and fro in sequence substantially in a direction of the center axis of the helical form of the first conductor to take, as a whole, a meandering form which is spaced apart from the first conductor and surrounds the center axis, and a dielectric member which lies at least between the first and second conductors, a portion of the first conductor being electrically connected to a portion of the second conductor and either a portion of the first conductor or a portion of the second conductor acting as a feeding point.

Firstly, the operation of the invention will be described which proceeds when an intermediate portion (a portion between one end and the other end) of the second conductor is used as a feeding point.

In this case, the second conductor forms, as viewed from the feeding point, two transmission lines in which the radiation resistance results in loss. one of the two transmission lines is a first transmission line formed of a portion (first portion) of the second conductor lying between the feeding point and one end and having an electrical connecting point to the first conductor. The other of the two transmission lines is a second transmission line formed of a portion (second portion) of the second conductor lying between the feeding point and the other end and having no electrical connecting point to the first conductor. If the length of the first portion of the second conductor is set to be sufficiently long for a desired exciting frequency acting on the antenna, then the input impedance of the first transmission line, as viewed from the feeding point, has a positive imaginary component of impedance (inductance). Thus, the second transmission line acts as an open stub on the first transmission line, having the function of compensating for the positive imaginary component of impedance of the first transmission line to permit matching of the antenna near a center value of the exciting frequency. On the other hand, the first conductor also acts as an open stub on the first transmission line. By selecting a suitable length of the first conductor and a suitable position of the electrical connecting point between the second and first conductors, the impedance of the first conductor can be set to a desired value. Therefore, a double resonance can be obtained near the center value of the exciting frequency to widen the band of impedance matching of the antenna. It will be appreciated that the first conductor takes the helical form and the second conductor takes the meandering form and so main directions of currents caused to flow in these conductors are substantially orthogonal to each other. Consequently, the first and second conductors operate independently from each other, facilitating design of the open stubs.

As described above, the second transmission line and the first conductor act as the open stubs on the first transmission line and so, according to the invention, a compact antenna of wide band can be obtained without using any separate matching circuit.

The operation of the invention has been described by referring to the case where an intermediate portion (a portion between one end and the other end) of the second conductor acts as the feeding point, but in accordance with the invention, an end portion of the second conductor may alternatively be used as the feeding point. In this case, the first open stub lacks but any matching circuit is unneeded as in the precedence.

Also, in the foregoing, the operation of the present invention has been described by referring to the case where a portion of the second conductor is used as the feeding point. However, a portion of the first conductor may act as the feeding point in accordance with the invention and even in such a case, a compact antenna of wide band can be obtained without resort to any separate matching circuit, as in the precedence.

According to another aspect of the invention, an antenna comprises a first conductor taking a helical form, a second conductor which extends to and fro in sequence substantially in a direction of the center axis of the helical form of the first conductor to take, as a whole, a meandering form which is spaced apart from the first conductor and surrounds the center axis, a dielectric member which lies at least between the first and second conductors, and a single or a plurality of fourth conductors spaced apart from the first conductor, a portion of the second conductor acting as a feeding point and a portion of the first conductor being electrically connected to a portion of at least one of the fourth conductors.

In this case, like the foregoing case, any matching circuit is essentially unneeded but since the first conductor is not electrically connected to the second conductor having the feeding point, the first conductor does not act as an open stub. Consequently, in comparison with the foregoing case, the order of the previously-described double resonance is decreased to narrow the frequency band which satisfies the matching condition. However, an unfed section comprised of the first and fourth conductors functions to permit fine adjustment of a center frequency of the matching frequency band, thus facilitating the adjustment of center frequency during fabrication.

With regard to another aspect of the present invention, the prior art idea disclosed in U.S. Pat. No. 4,772,895 cited above is featured in that a separate matching circuit need not be provided, and the frequency band can be widened by the multiple resonance of the plural antennas having the respectively different electric lengths. The cited U.S. patent is further featured in that, because of the helical shape of the antennas, they have a strong force of restitution, so that good radio wave directivity and high strength suitable for a mobile portable receiver can be obtained.

However, a straight electrical conductor is commonly prepared in order to manufacture such a helical antenna, and a helical antenna manufacturing apparatus is generally required so that pitch values required for reducing displacement current produced between the individual pitches, diameter values of a plurality of kinds of helical antennas having respectively different diameters required for producing multiple resonance, etc. can be accurately obtained. From both the technical aspect and the commercial aspect, it is apparent that such an apparatus requires high manufacturing costs. Even if such a plurality of kinds of helical antennas could be actually manufactured by the use of such a helical antenna manufacturing apparatus, the mass productivity would become a problem in view of the complexity of the manufacturing steps and a large length of time required for manufacturing each of the helical antennas.

In addition, it is the recent tendency that the frequency band used by a portable receiver (a cellular receiver) has the range of 0.9 GHz to 1.5 GHz. Thus, the electric length, that is λ (wavelength)/4, of the antenna required to operate in, for example, the frequency band in the vicinity of 1.5 GHz is only about 50 mm. Therefore, when the antennas are arranged in a relation spaced apart by a distance (more than about 1 to 3 mm) required for substantially minimizing the adverse effect of the displacement current, the antenna of small size having sufficiently high strength can be made without the necessity for shaping the antenna into the helical form.

Therefore, it is another object of the present invention to provide an antenna of small size which can be mass-produced and has a wide frequency band.

The present invention which attains the above object provides an antenna of small size for a portable receiver comprising a plurality of meander antennas printed on at least one film of a dielectric material and satisfying respectively different resonance conditions in the frequency band used by the receiver, at least one solid cylinder of a dielectric material for winding the dielectric film therearound, and a hollow cylinder of a dielectric material for covering the dielectric film wound around the dielectric solid cylinder, wherein the individual meander antennas printed on the dielectric film do not make direct electrical contact with each other, and one of the meander antennas connected to a feeder acts to produce multiple resonance by means of electromagnetic coupling with the other meander antennas, thereby widening the frequency band.

According to the present invention, the plural meander antennas are printed on the dielectric film in the initial stage of the antenna manufacturing process. Therefor, the antenna of small size can be mass-produced at low costs without using any special manufacturing apparatus.

Further, because the electric length that is λ (wavelength)/4 required for a portable receiver using the frequency band in the vicinity of 1 GHz is about 75 mm, the antenna connected to the feeder is desirably shaped into the helical form in order to provide predetermined strength. When a straight electrical conductor about 75 mm long is shaped into the form of the helical antenna, the practical size of the helical antenna is about 30 mm to 40 mm long, and its diameter is about 8.5 mm.

However, when another helical antenna having a diameter different from that of the antenna having the helical shape is combined with the latter antenna for the purpose of producing the multiple resonance, the arrangement results in the prior art requirement with respect to the accuracy of manufacturing these two kinds of the helical antennas having the respectively different diameters.

Thus, it is yet another object of the present invention to provide an antenna of small size in which meander antennas are printed on at least one film of a dielectric material to produce multiple resonance together with one helical antenna so as to widen the frequency band and which can be made at a cost lower than that of the aforementioned prior art antenna in which two kinds of helical antennas must be accurately manufactured.

The present invention which attains this object provides an antenna of small size for a portable receiver comprising a plurality of meander antennas printed on at least one film of a dielectric material and satisfying respectively different resonance conditions in the frequency band used by the receiver, at least one solid cylinder of a dielectric material for winding the dielectric film therearound, a hollow cylinder of a dielectric material for covering the dielectric film wound around the dielectric solid cylinder, and a helical antenna wound around the dielectric hollow cylinder and connected to a feeder, wherein the individual meander antennas printed on the dielectric film and the helical antenna do not make direct electrical contact with each other, and the helical antenna and the individual meander antennas are spaced apart from each other so as to produce multiple resonance by means of electromagnetic coupling, thereby widening the frequency band of the helical antenna.

According to another aspect of the present invention, only one kind of the helical antenna relatively different to manufacture is used, and, the other members are provided by, for example, the dielectric hollow cylinder and the plural meander antennas printed on the dielectric film so that the desired multiple resonance can be easily produced together with the helical antenna. Thus, the antenna of small size according to this aspect of the present invention can be manufactured with the accuracy two or more times as high as that of the prior art one and with the cost ½ times or less than that of the prior art one.

The foregoing and other objects, advantages, manner of operation and novel features of the present invention will be understood from the following detailed description when read in connection with the accompanying drawings.

DESCRIPTION OF THE PREFERRED EMBODIMENTS

An antenna for radio apparatus of the invention will now be described by way of example with reference to the accompanying drawings.

A first embodiment of the invention will be described by making reference to FIGS. 1A to 1D.

Figure 1A:
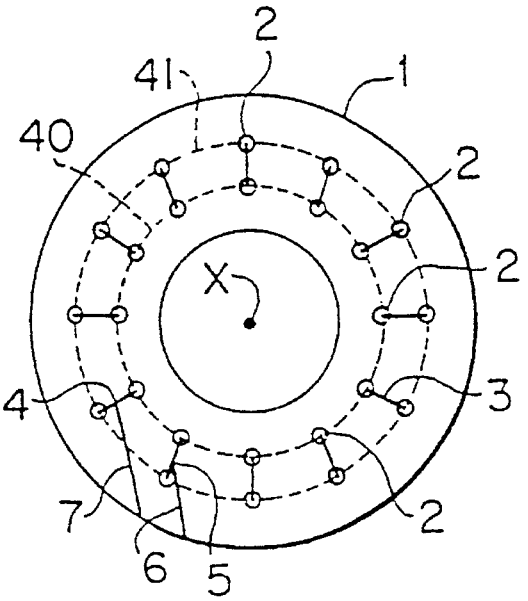
FIG. 1A is a top view of an antenna for radio apparatus according to a first embodiment of the invention.
Figure 1B:
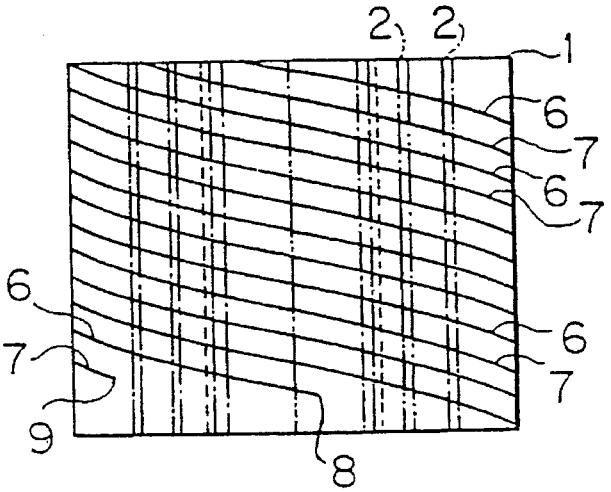
FIG. 1B is a side view of the FIG. 1A radio apparatus antenna.
Figure 1C:
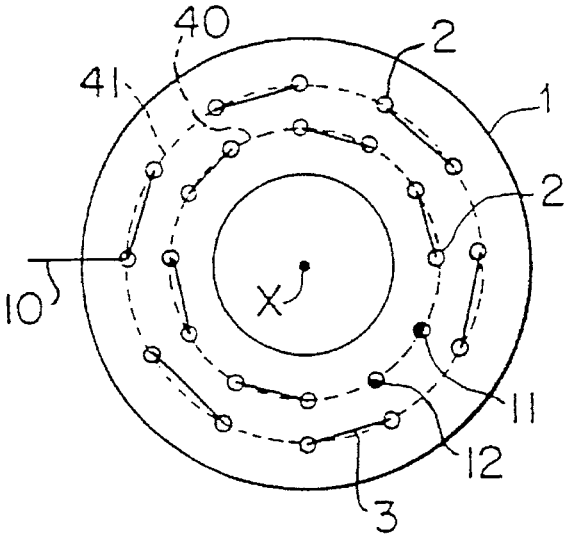
FIG. 1C is a bottom view of the FIG. 1A radio apparatus antenna.
Figure 1D:
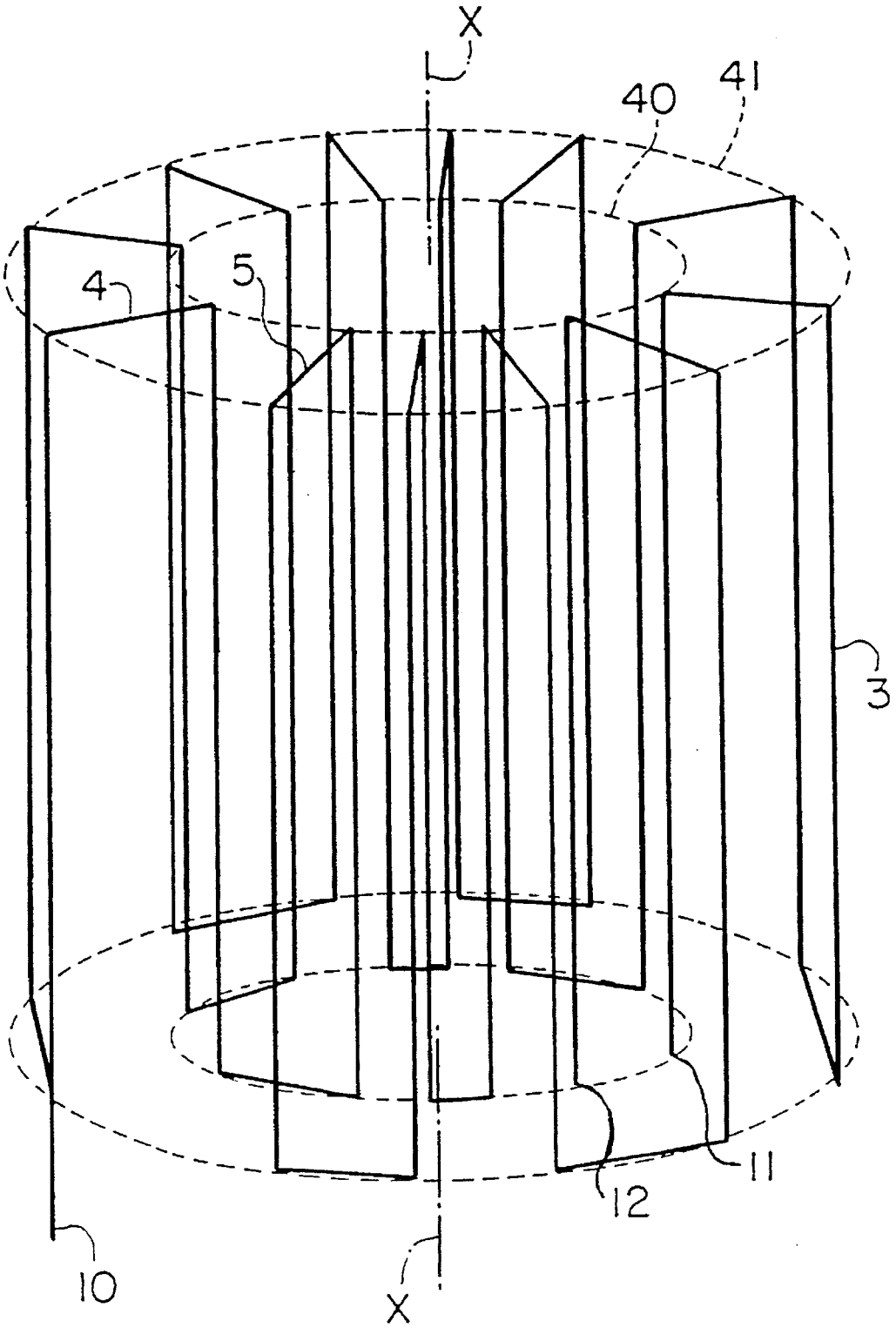
FIG. 1D is a schematic perspective view showing a conductor of the FIG. 1A radio apparatus antenna.

FIGS. 1A to 1C are a top view, a side view and a bottom view of an antenna for radio apparatus according to the first embodiment of the invention, respectively. In these figures, reference numeral 1 designates a dielectric member, 7 a first conductor taking a helical form, 3 a second conductor taking a meandering form and 6 a third conductor taking a helical form. The second conductor 3 is particularly illustrated, in perspective form, in FIG. 1D. In the first embodiment, the dielectric member takes the form of a cylinder. In the dielectric member 1, imaginary, concentric double cylindrical surfaces of inner surface 40 and outer surface 41 are assumed which surround the center axis X, of the cylinder form of dielectric member 1, and guide holes 2 are formed in the inner and outer surfaces in a direction of the center axis X. The second conductor 3 having one end at a start point 11 extends along the guide holes 2 in sequence thereof to take a crank-like meandering form and terminates in the other end at an end point 12. More specifically, as best seen in FIG. 1D, the second conductor 3 extends to and fro in sequence in the direction of the center axis X to take, as a whole, the meandering form which completely surrounds the center axis X. in the first embodiment, parts of the second conductor 3 are exposed to the bottom and top surfaces of the dielectric member 1. The second conductor 3 has an intermediate portion included in the parts exposed to the bottom surface of the dielectric member 1 and this portion is selected as a feeding point 10. The first conductor 7 is wound on the outer surface of the dielectric member I by taking the helical form. The center axis of the helical form of the first conductor 7 coincides with the center axis X. Accordingly, the second conductor 3 is spaced apart from the first conductor 7 to leave a plenum which is a part of the dielectric member 1. One end of the first conductor 7 is electrically connected at a connecting point 4 to an intermediate portion of second conductor 3 included in the parts exposed to the top surface of the dielectric member 1. The other end of the first conductor 7 is opened at an ending point 9. In other words, the ending point 9 is not connected electrically to any other parts. The third conductor 6 is also wound on the outer surface of the dielectric member 1 by taking the helical form. The third conductor 6 does not contact the first conductor 7 to form together therewith a multi-helical structure (a double helical structure in this example). One end of the third conductor 6 is electrically connected at a connecting point 5 to an intermediate portion of second conductor 3 included in the parts exposed to the top surface of the dielectric member 1. The other end of the third conductor 6 is opened at an ending point 8. Namely, the ending point 8 is not connected electrically to any other parts.

Figure 2:
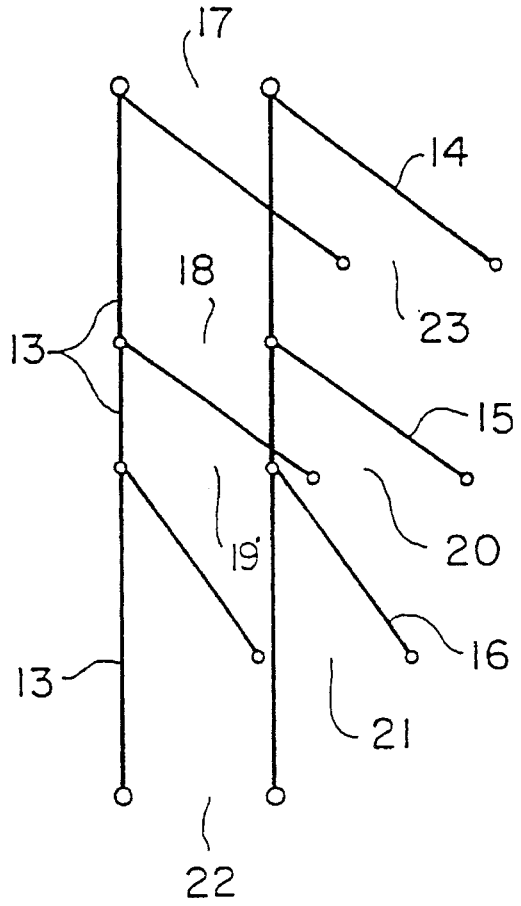
FIG. 2 is a diagram showing a transmission line model of the radio apparatus antenna shown in FIGS. 1A to 1D.

As viewed from the feeding point 10, the antenna for radio apparatus according to the first embodiment shown in FIGS. 1A to 1D can be expressed equivalently by a transmission line model as shown in FIG. 2. A transmission line input terminal 17 corresponds to the feeding point 10. A portion of second conductor 3 lying between the feeding point 10 and the end point 12 corresponds to a transmission line 13, and a portion of second conductor 3 lying between the feeding point 10 and the start point 11 corresponds to a transmission line 14. The connecting points, 4 and 5 correspond to other transmission lines 18 and 19, which have different characteristic impedance, respectively. The first conductor 7 corresponds to an open stub 15 and the third conductor 6 corresponds to an open stub 16. The start point 11 of the second conductor 3, the end point 12 of the second conductor 3, the ending point 9 of the first conductor 7 and the ending point 8 of the third conductor 6 correspond to transmission line terminals 23, 22, 20 and 21, respectively. If the length of transmission line 13 is set to be sufficiently large for an exciting frequency of the antenna, then the impedance of transmission line 13 as viewed from the input terminal 17 will be inductive. Since the transmission line 14 is connected in parallel with the transmission line 13, the transmission line 14 acts as an open stub on the transmission line 13 to ensure that the impedance of the antenna can match with the feeding impedance near a center value of the exciting frequency. Further, by selecting suitable lengths of the first and third conductors 7 and 6 as well as suitable positions of the connecting points 4 and 5 in the second conductor 3, the impedances of the open stubs 15 and 16 can be set to desired values. Therefore, with the open stubs 15 and 16, a double resonance can be realized near the center value of the exciting frequency to thereby expand a frequency band which satisfies the matching condition defined by a desired reflection wave characteristic.

Figure 3:
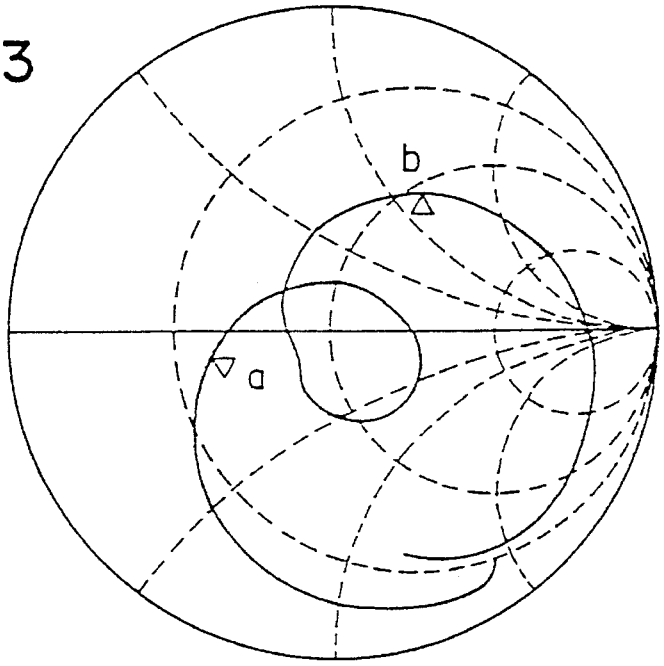
FIG. 3 is a Smith chart showing an example of the matching condition of the radio apparatus antenna shown in FIGS. 1A to 1D.

FIG. 3 depicts an example of a Smith chart showing the condition matched with 50Ω as viewed from the feeding point 10 in the antenna for radio apparatus of the first embodiment. As is clear from this Smith chart normalized by 50Ω, the good matching condition purporting that VSWR<2.5 stands can be realized in a desired frequency band covering a and b.

A second embodiment of the invention will now be described with reference to FIGS. 4A to 4C.

Figure 4A:
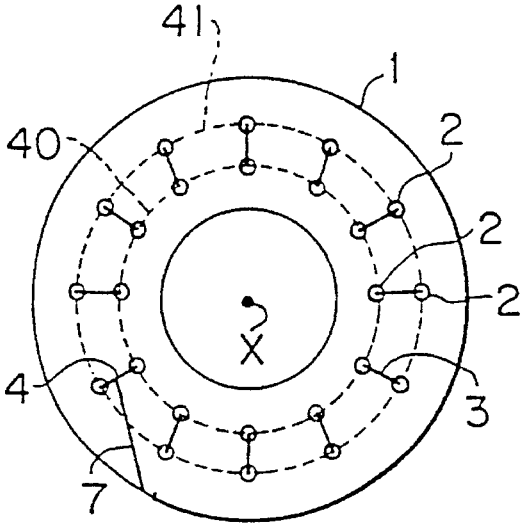
FIG. 4A is a top view of antenna for radio apparatus according to a second embodiment of the invention.
Figure 4B:
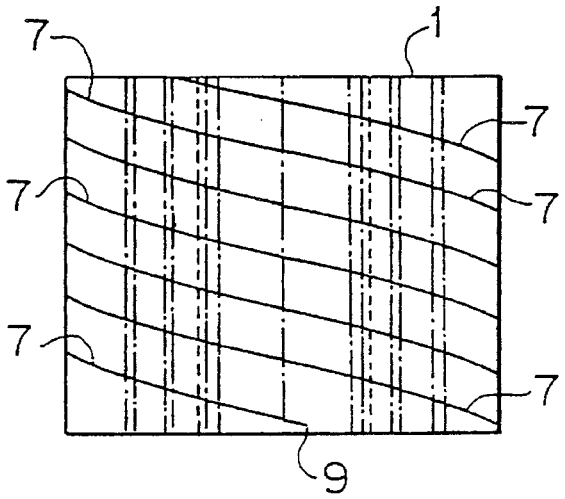
FIG. 4B is a side view of the FIG. 4A radio apparatus antenna.
Figure 4C:
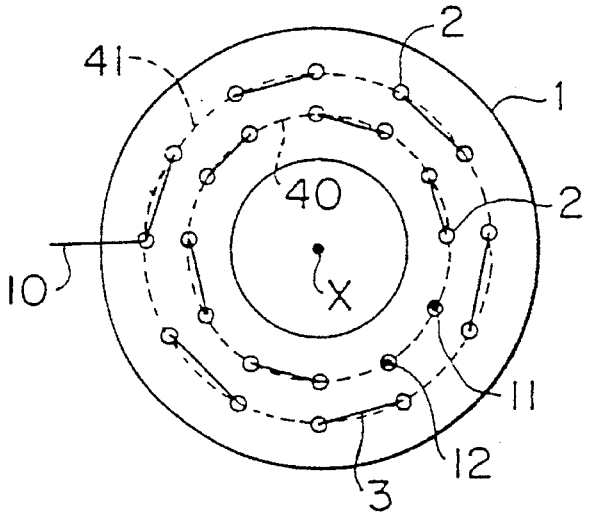
FIG. 4C is a bottom view of the FIG. 4A radio apparatus antenna.

FIGS. 4A to 4C are a top view, a side view and a bottom view of an antenna for radio apparatus according to the second embodiment of the invention, respectively. In these figures, the same components as those of the previously-described first embodiment shown in FIGS. 1A to 1D are designated by the same reference numerals and will not be described herein. The second embodiment differs from the first embodiment only in that the second embodiment lacks the third conductor 6 provided in the first embodiment. Accordingly, in the case of the second embodiment, the order of the double resonance is decreased as compared to the first embodiment to narrow the frequency band which satisfies the matching condition but the production cost can be reduced to advantage. Therefore, the antenna for radio apparatus of the second embodiment can be suitably applicable to the case where the required frequency band is not so wide.

A third embodiment of the invention will now be described with reference to FIGS. 5A to 5D.

Figure 5A:
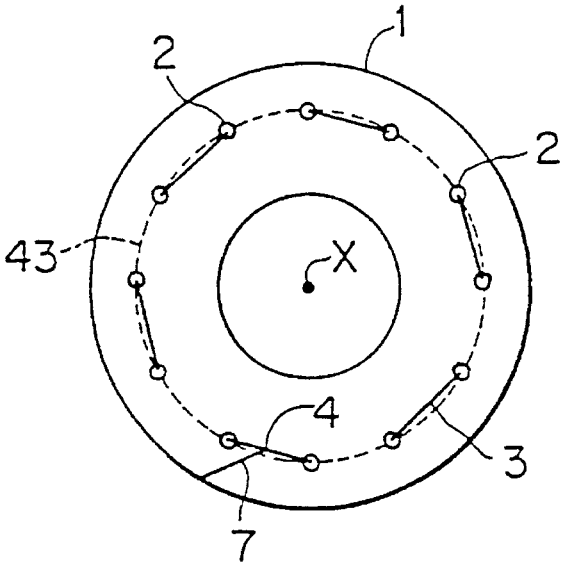
FIG. 5A is a top view of an antenna for radio apparatus according to a third embodiment of the invention.
Figure 5B:
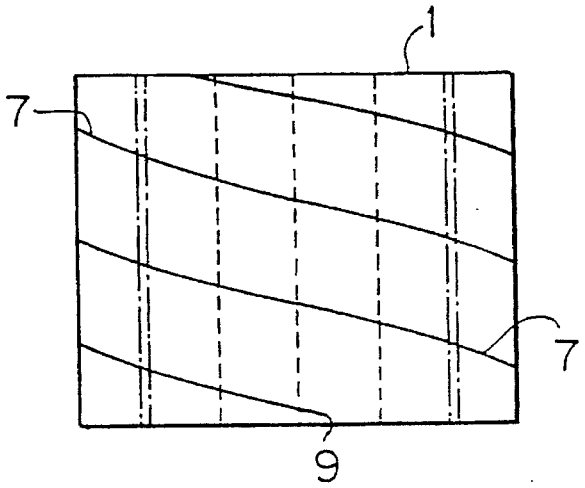
FIG. 5B is a side view of the FIG. 5A radio apparatus antenna.
Figure 5C:
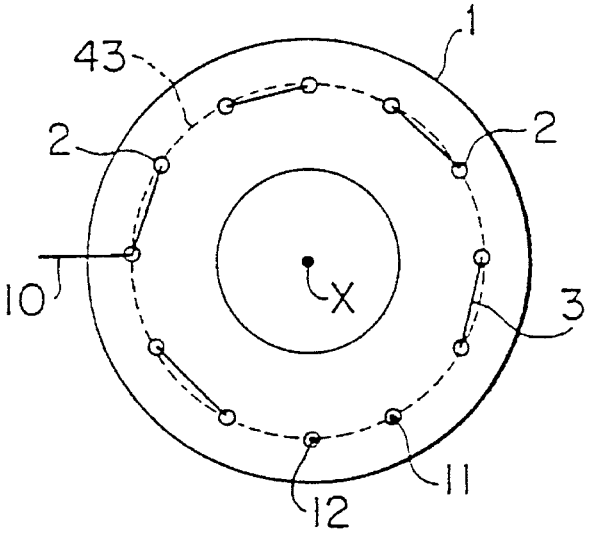
FIG. 5C is a bottom view of the FIG. 5A radio apparatus antenna.
Figure 5D:
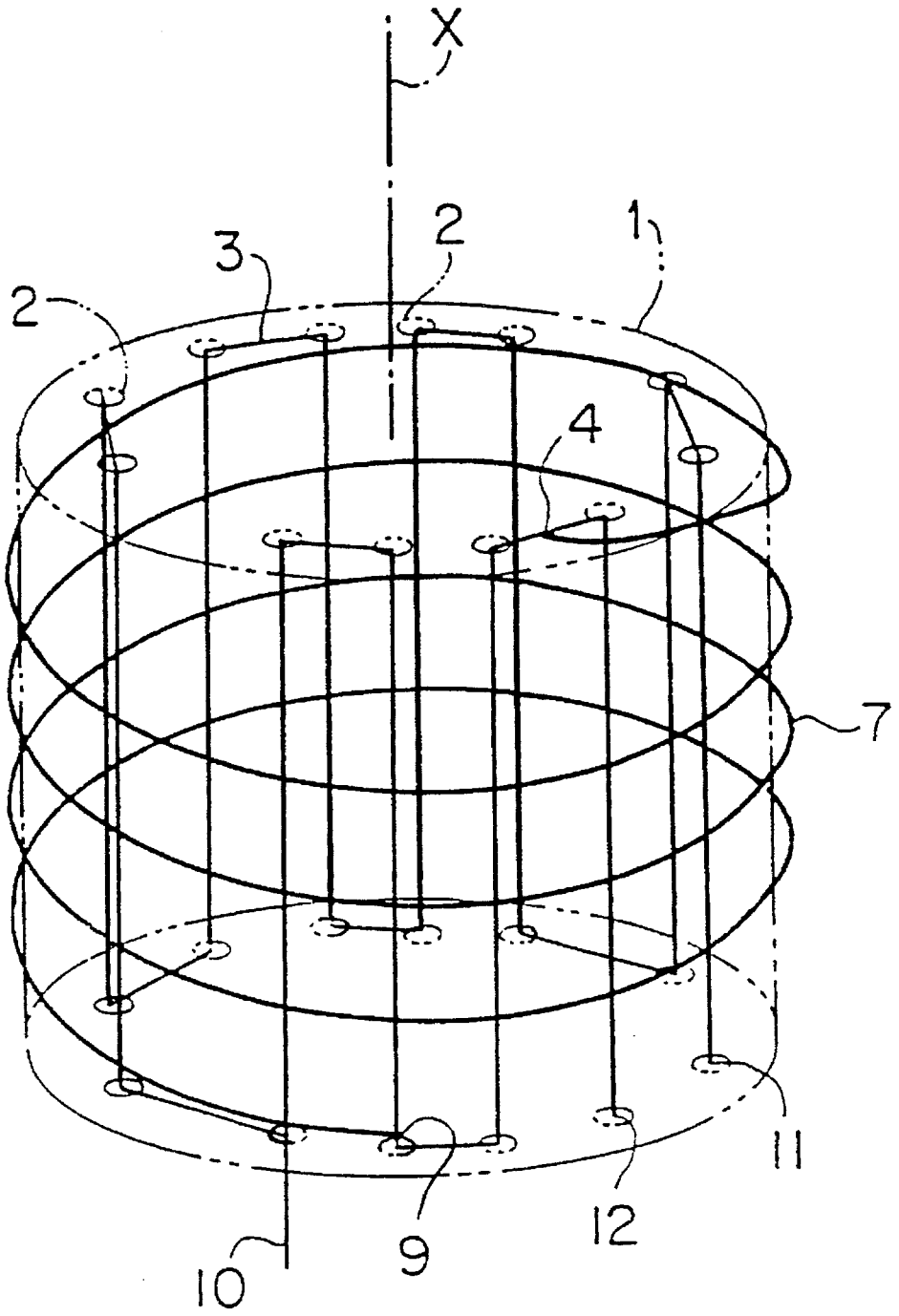
FIG. 5D Is a schematic perspective view showing conductors of the FIG. 5A radio apparatus antenna.

FIGS. 5A to 5C are a top view, a side view and a bottom view of an antenna for radio apparatus according to the third embodiment of the invention, respectively. FIG. 5D is a perspective view showing a first conductor 7 and a second conductor 3. In these figures, components like those of the previously described second embodiment shown in FIGS. 4A to 4C are designated by identical reference numerals and their descriptions will be omitted. The third embodiment is identical with the second embodiment with the only exception of the form of the second conductor 3. More specifically, in the third embodiment, the second conductor 3 takes a meandering form along an imaginary, concentric cylindrical surface 43 which is assumed to be in a dielectric member 1. The third embodiment is disadvantageous to lower frequencies because the overall length of the second conductor 3 can not be longer than that in the second embodiment, but advantageously the construction is simplified to reduce the production cost. Therefore, the antenna for radio apparatus of the third embodiment is suitable for the case where the required frequency band does not extend to so low a frequency.

Now, a fourth embodiment of the invention will be described with reference to FIGS. 6A to 6C.

Figure 6A:
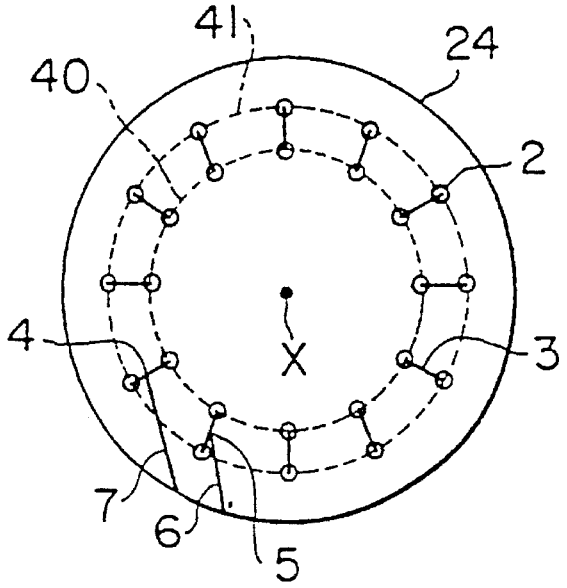
FIG. 6A is a top view of an Antenna for radio apparatus according to a fourth embodiment of the invention.
Figure 6B:
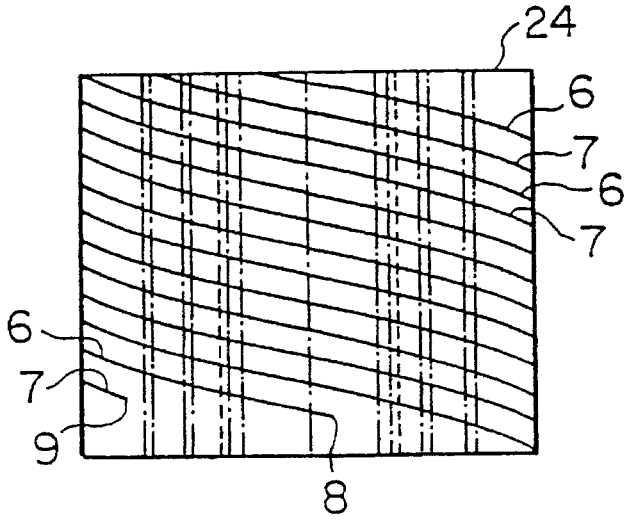
FIG. 6B is a side view of the FIG. 6A radio apparatus antenna.
Figure 6C:
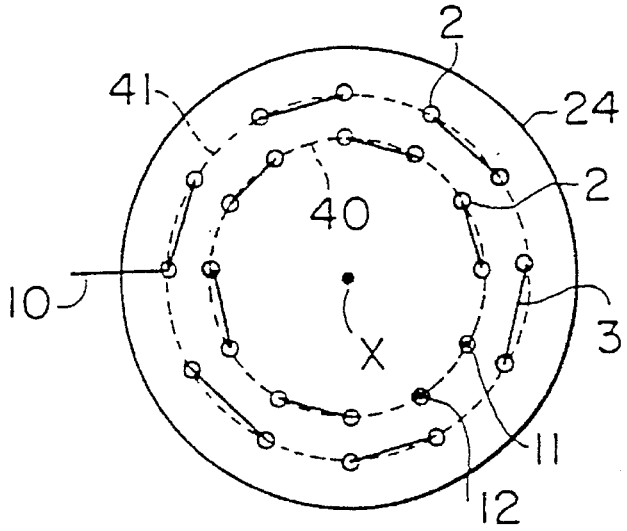
FIG. 6C is a bottom view of the FIG. 6A radio apparatus antenna.

FIGS. 6A to 6C are a top view, a side view and a bottom view of an antenna for radio apparatus according to the fourth embodiment of the invention, respectively. In these figures, components like those of the previously-described first embodiment shown in FIGS. 1A to 1D are designated by identical reference numerals and their descriptions will be omitted. The fourth embodiment differs from the first embodiment only in that while in the first embodiment the cylindrical dielectric member is used, a dielectric member 24 taking a columnar form is used in the fourth embodiment. The antenna for radio apparatus of the fourth embodiment can also provide a characteristic similar to that obtained with the first embodiment and besides, in comparison with the dielectric member 1 of the first embodiment, the dielectric member 24 taking the columnar form attains such advantages that it is easy to manufacture and is increased in mechanical strength to ultimately increase mechanical strength of the whole antenna.

A fifth embodiment of the invention will now be described with reference to FIGS. 7A to 7D.

Figure 7A:
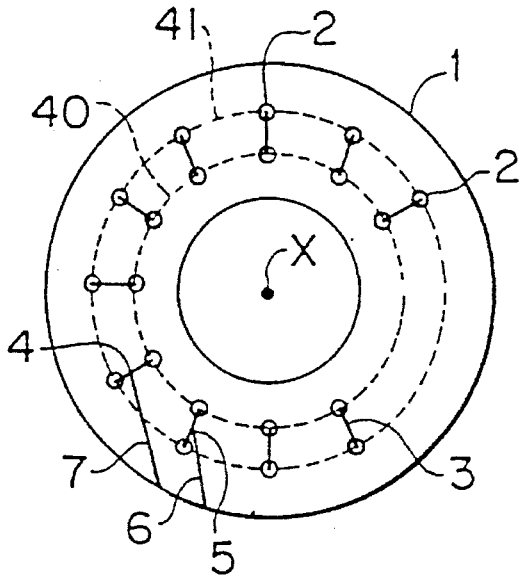
FIG. 7A is a top view of an antenna for radio apparatus according to a fifth embodiment of the invention.
Figure 7B:
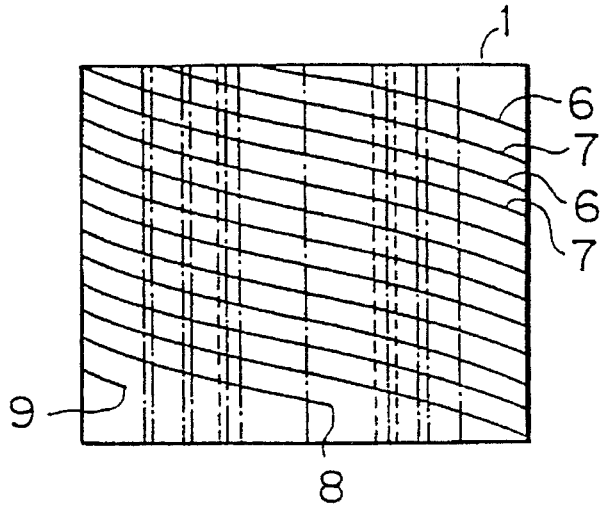
FIG. 7B is a side view of the FIG. 7A radio apparatus antenna.
Figure 7C:
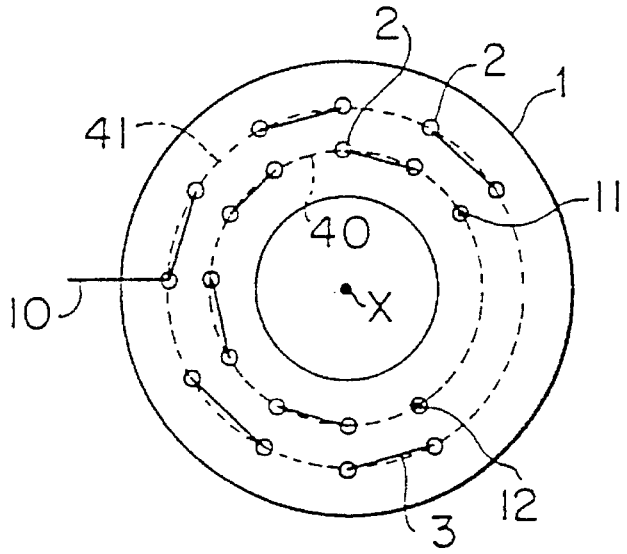
FIG. 7C is a bottom view of the FIG. 7A radio apparatus antenna.
Figure 7D:
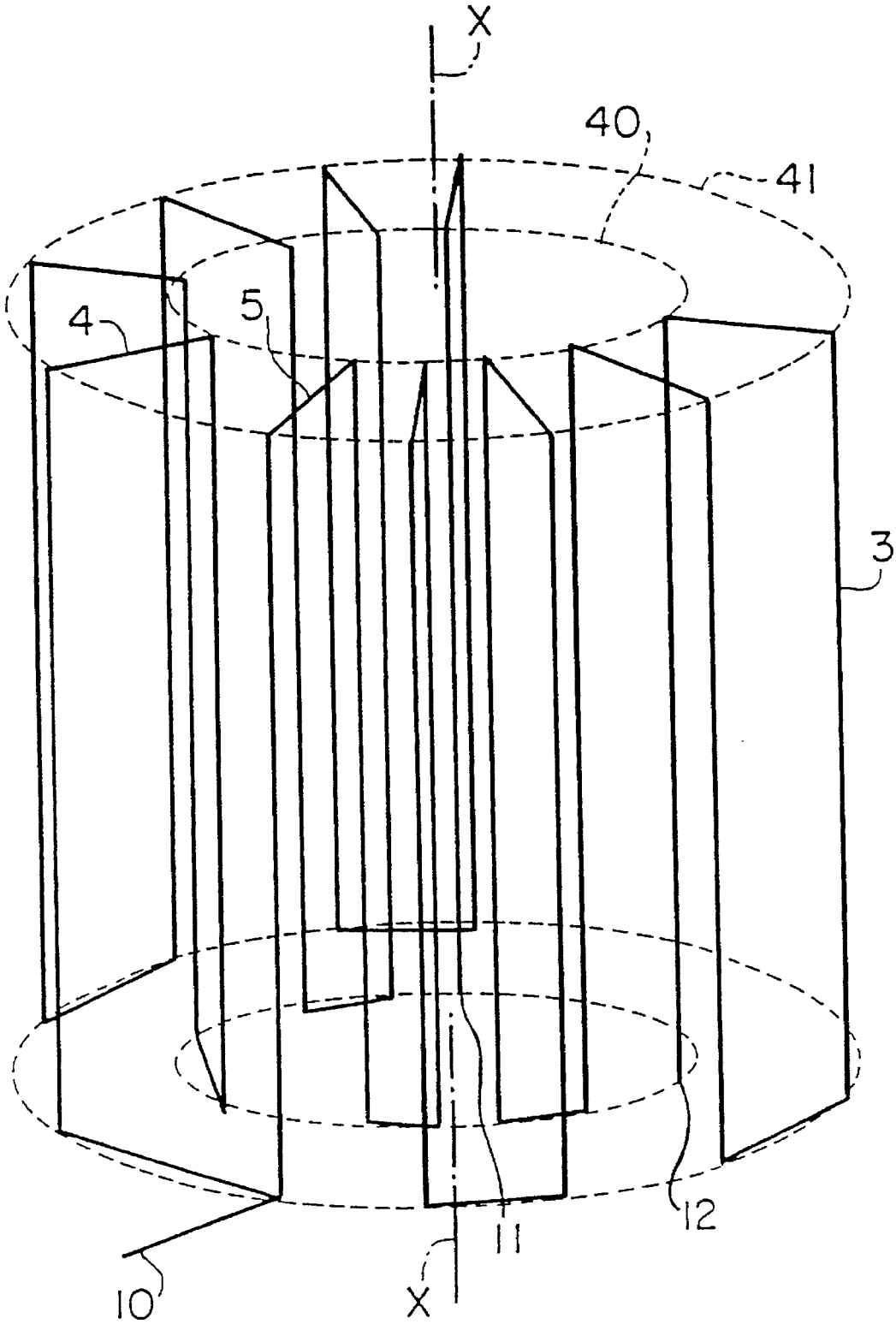
FIG. 7D is a schematic perspective view showing a conductor of the FIG. 7A radio apparatus antenna.

FIGS. 7A to 7C are a top view, a side view and a bottom view of an antenna for radio apparatus according to the fifth embodiment of the invention, respectively. FIG. 7D is a perspective view of a second conductor 3. In these figures, components like those of the previously-described first embodiment are designated by identical reference numerals and their descriptions will be omitted. The fifth embodiment differs from the first embodiment only in that while in the first embodiment the second conductor 3 as a whole takes the meandering form which completely surrounds the center axis X, the second conductor 3 in the fifth embodiment takes as a whole a meandering form which partially surrounds the center axis X. In the fifth embodiment, intensity of radiation of electromagnetic wave is relatively decreased in a direction in which the second conductor 3 is absent as viewed from the center axis X. Accordingly, by packaging the radio apparatus antenna of the fifth embodiment in a terminal in such a manner that the direction of elements apt to be adversely affected by radiation of electric wave (for example, wiring patterns of a microcomputer comprised in the terminal) coincides with the direction of the absence of the second conductor 2, interaction of unwanted high frequency signals with the elements can advantageously be suppressed. The overall length of the second conductor 3 is shorter in the fifth embodiment than in the first embodiment and therefore the fifth embodiment is suitable for the case where the required overall length of the second conductor 3 is not so long.

A sixth embodiment of the invention will now be described with reference to FIGS. 8A to 8C.

Figure 8A:
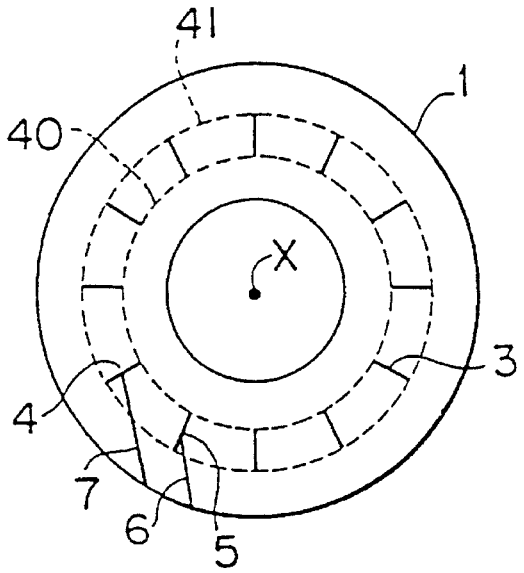
FIG. 8A is a top view of an antenna for radio apparatus according to a sixth embodiment of the invention.
Figure 8B:
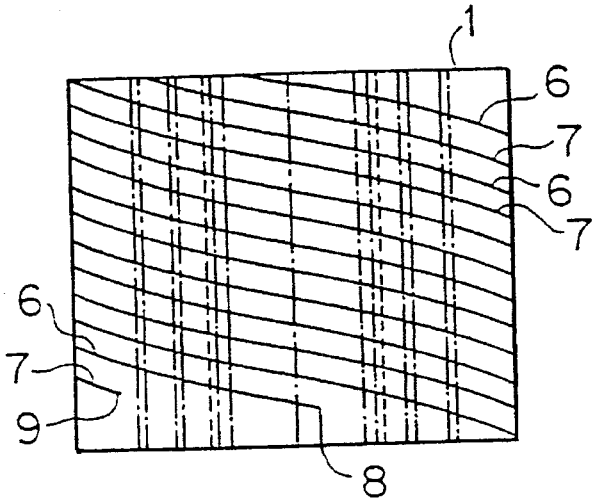
FIG. 8B is a side view of the FIG. 8A radio apparatus antenna.
Figure 8C:
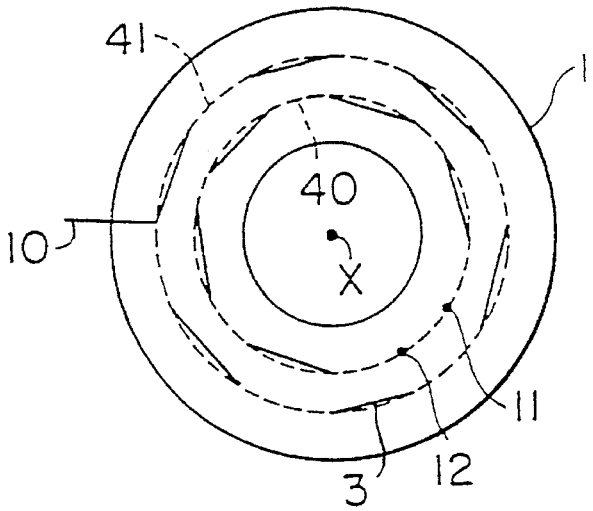
FIG. 8C is a bottom view of the FIG. 8A radio apparatus antenna.

FIGS. 8A to 8C are a top view, a side view and a bottom view of an antenna for radio apparatus according to the sixth embodiment of the invention, respectively. In these figures, components like those of the previously-described first embodiment are designated by identical reference numerals and their descriptions will be omitted. The sixth embodiment differs from the first embodiment only in that while in the first embodiment the second conductor 3 is guided through the guide holes 2 formed in the dielectric member 1, such guide holes are not formed in a dielectric member 1 in accordance with the sixth embodiment and the second conductor 3 is embedded directly in the dielectric member 1. The sixth embodiment requires an integral formation technique for its manufacture but advantageously the relative position of the second conductor 3 in the dielectric member 1 permanently remains unchanged to suppress changes in characteristics with time.

A seventh embodiment of the invention will now be described with reference to FIGS. 9A to 9D.

Figure 9A:
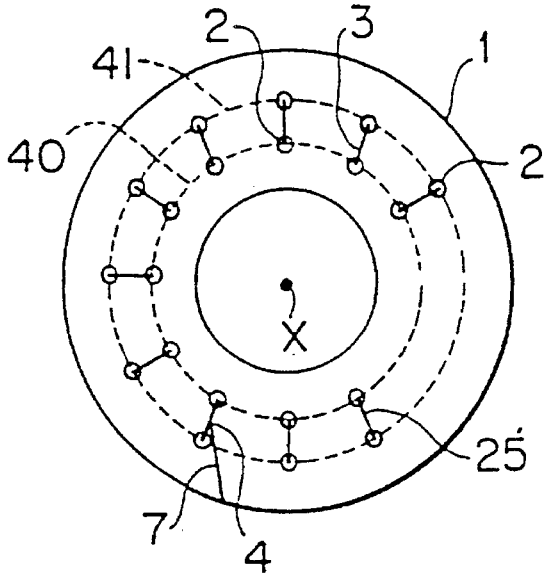
FIG. 9A is a top view of an antenna for radio apparatus according to a seventh embodiment of the invention.
Figure 9B:
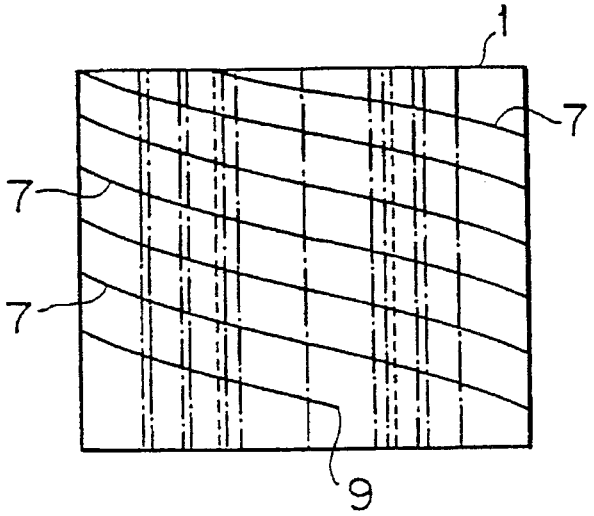
FIG. 9B is a side view of the FIG. 9A radio apparatus antenna.
Figure 9C:
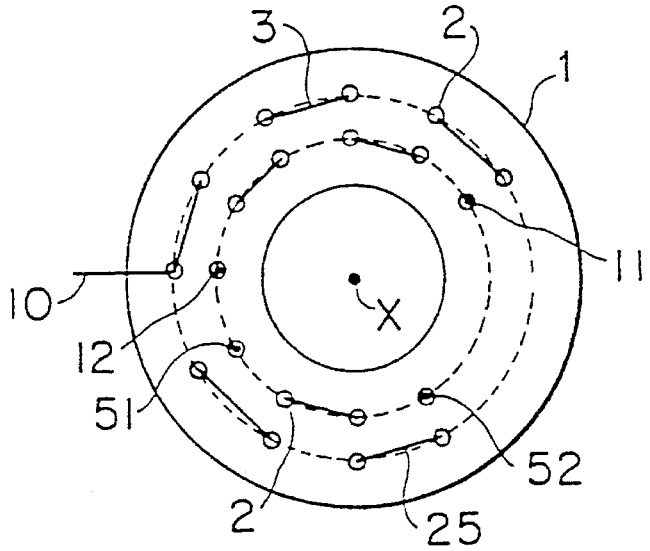
FIG. 9C is a bottom view of the FIG. 9A radio apparatus antenna.
Figure 9D:
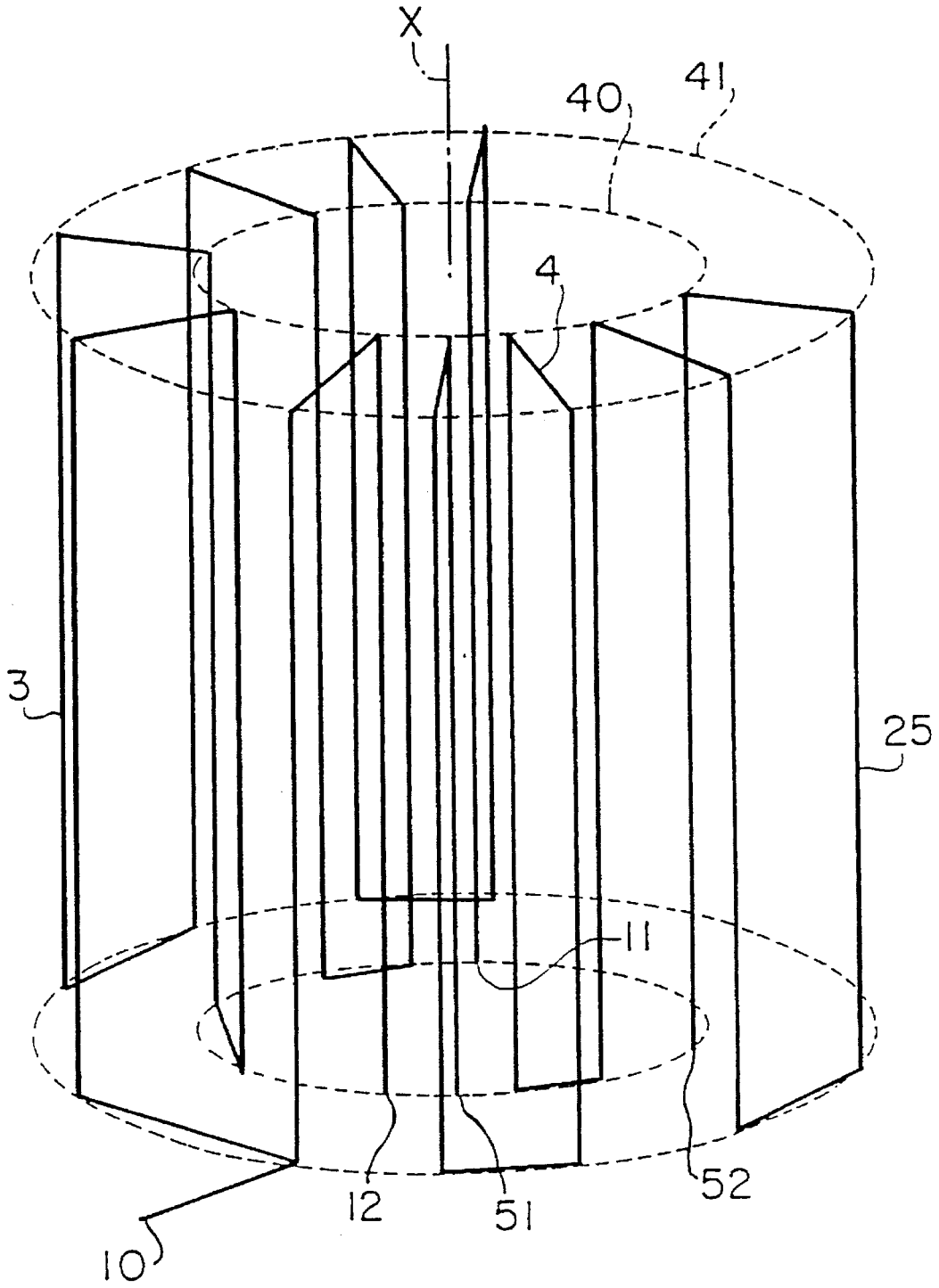
FIG. 9D is a schematic perspective view showing conductors of the FIG. 9A radio apparatus antenna.

FIGS. 9A to 9C are a top view, a side view and a bottom view of an antenna for radio apparatus according to the seventh embodiment of the invention. FIG. 9D is a perspective view showing a second conductor 3 and a fourth conductor 25. In these figures, components like those of the previously-described second embodiment shown in FIGS. 4A to 4C are designated by identical reference numerals and their descriptions will be omitted. The seventh embodiment differs from the second embodiment in that while in the second embodiment the second conductor 3 as a whole takes the meandering form which completely surrounds the center axis X, the second conductor 3 in the seventh embodiment takes as a whole a meandering form which partially surrounds the center axis X, that the seventh embodiment has the fourth conductor 25, and that in the seventh embodiment a first conductor 7 is not electrically connected to the second conductor 3 but is electrically connected at a connecting point 4 to the fourth conductor 25. In the seventh embodiment, the fourth conductor 25 having one end at a start point 51 extends along guide holes 2 in sequence thereof to take a meandering form and terminates in the other end at an end point 52. Accordingly, the fourth conductor 25 is spaced apart from the first conductor 7. Since in the seventh embodiment the first conductor 7 is not electrically connected to the second conductor 3 having a feeding point 10, the first conductor 7 does not act as an open stub on a portion of second conductor 3 lying between start point 11 and feeding point 10. Accordingly, in comparison with the second embodiment, the order of the previously-described double resonance is decreased to narrow the frequency band which satisfies the matching condition. The seventh embodiment, however, has an unfed section (a set of first and fourth conductors 7 and 25) and the function of this unfed section can advantageously be utilized to carry out fine adjustment of the center frequency of the matching frequency band to thereby facilitate the adjustment of center frequency during fabrication.

Referring now to FIGS. 10A to 10D, an eighth embodiment of the invention will be described.

Figure 10A:
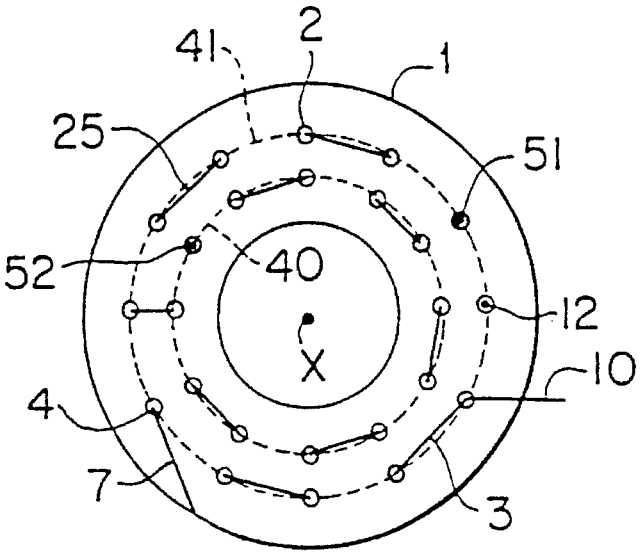
FIG. 10A is a top view of an antenna for radio apparatus according to an eighth embodiment of the invention.
Figure 10B:
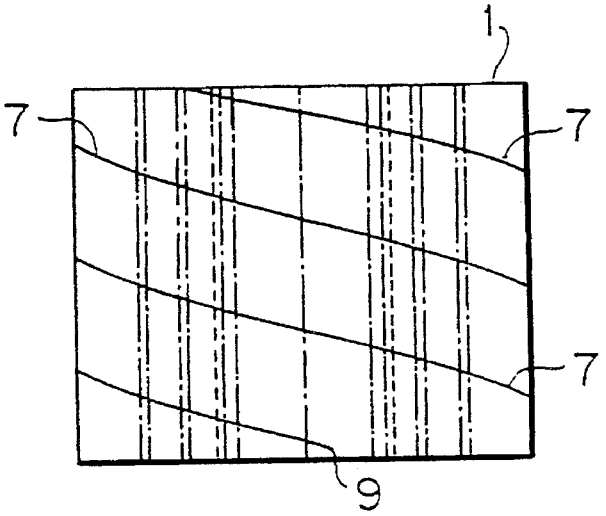
FIG. 10B is a side view of the FIG. 10A radio apparatus antenna.
Figure 10C:
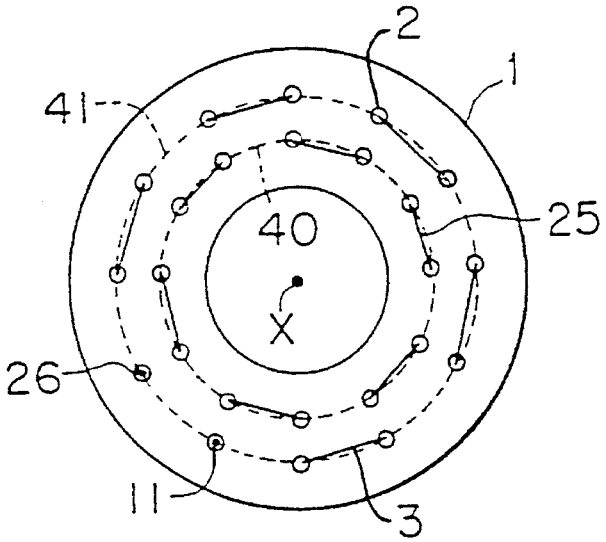
FIG. 10C is a bottom view of the FIG. 10A radio apparatus antenna.
Figure 10D:
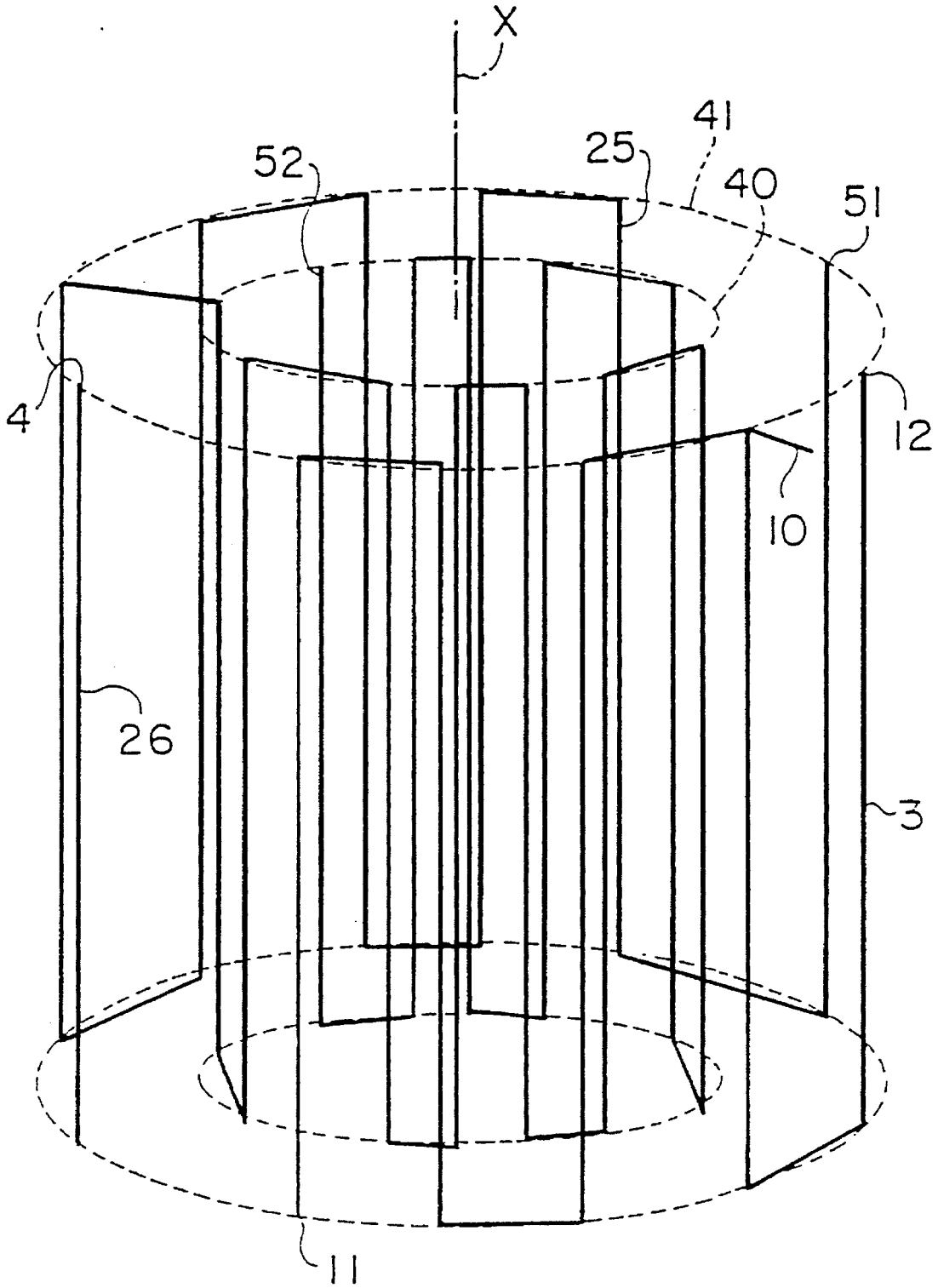
FIG. 10D is a schematic perspective view showing conductors of the FIG. 10A radio apparatus antenna.

FIGS. 10A to 10C are a top view, a side view and a bottom view of an antenna for radio apparatus according to the eighth embodiment of the invention. FIG. 10D is a perspective view showing a second conductor 3 and two fourth conductors 25 and 26. In these figures, components like those of the previously described second embodiment shown in FIGS. 4A to 4C are designated by identical reference numerals and their descriptions will be omitted. The eighth embodiment differs from the second embodiment in that while in the second embodiment the second conductor 3 as a whole takes the meandering form which completely surrounds the center axis X, the second conductor 3 in the eighth embodiment takes as a whole a meandering form which partially surrounds the center axis X, that the eighth embodiment has the two fourth conductors 25 and 26, and that in the eighth embodiment a first conductor 7 is not electrically connected to the second conductor 3 but is electrically connected at a connecting point 4 to the fourth conductor 26. In the eighth embodiment, the fourth conductor 26 is rectilinear. The fourth conductor 25 having one end at a start point 51 extends along guide holes 2 in sequence thereof to take a meandering form and terminates in the other end at an end point 52. Thus, the fourth conductors 25 and 26 are spaced apart from the first conductor 3. The fourth conductor 25 is not electrically connected to any other conductors. Since in the eighth embodiment the first conductor 7 is not electrically connected to the second conductor 3 having a feeding point 10, the first conductor 7 does not act as an open stub on a portion of second conductor 3 lying between start point 11 and feeding point 10. Accordingly, in comparison with the second embodiment, the order of the previously-described double resonance is decreased to narrow the frequency band which satisfies the matching condition. The eighth embodiment, however, has an unfed section (a set of first and fourth conductors 7 and 26 as well as the fourth conductor 25) and the function of this unfed section can advantageously be utilized for fine adjustment of the center frequency of the matching frequency band, thereby facilitating the adjustment of center frequency during fabrication.

Referring now to FIGS. 11A to 11D, a ninth embodiment of the invention will be described.

Figure 11A:
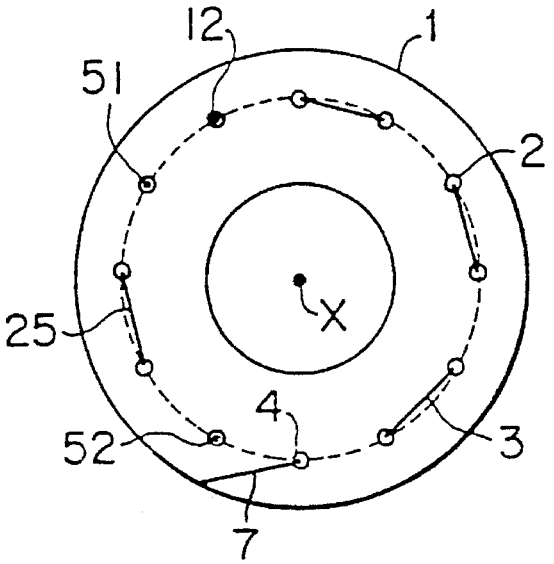
FIG. 11A is a top view of an antenna for radio apparatus according to a ninth embodiment of the invention.
Figure 11B:
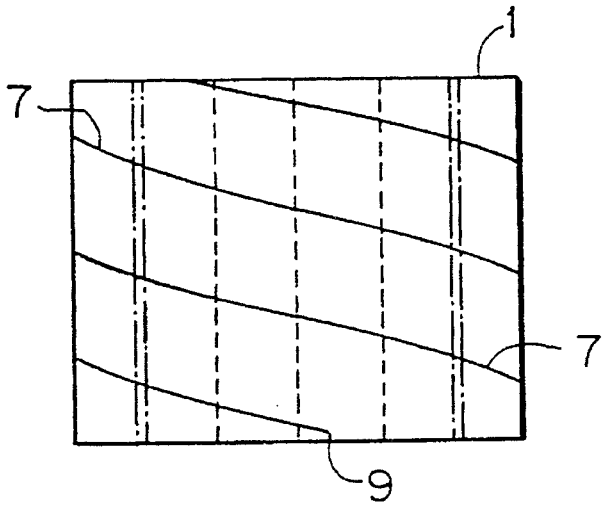
FIG. 11B is a side view of the FIG. 11A radio apparatus antenna.
Figure 11C:
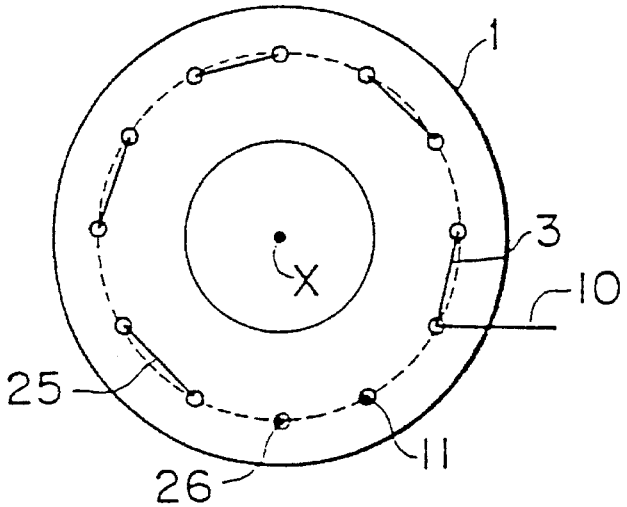
FIG. 11C is a bottom view of the FIG. 11A radio apparatus antenna.
Figure 11D:
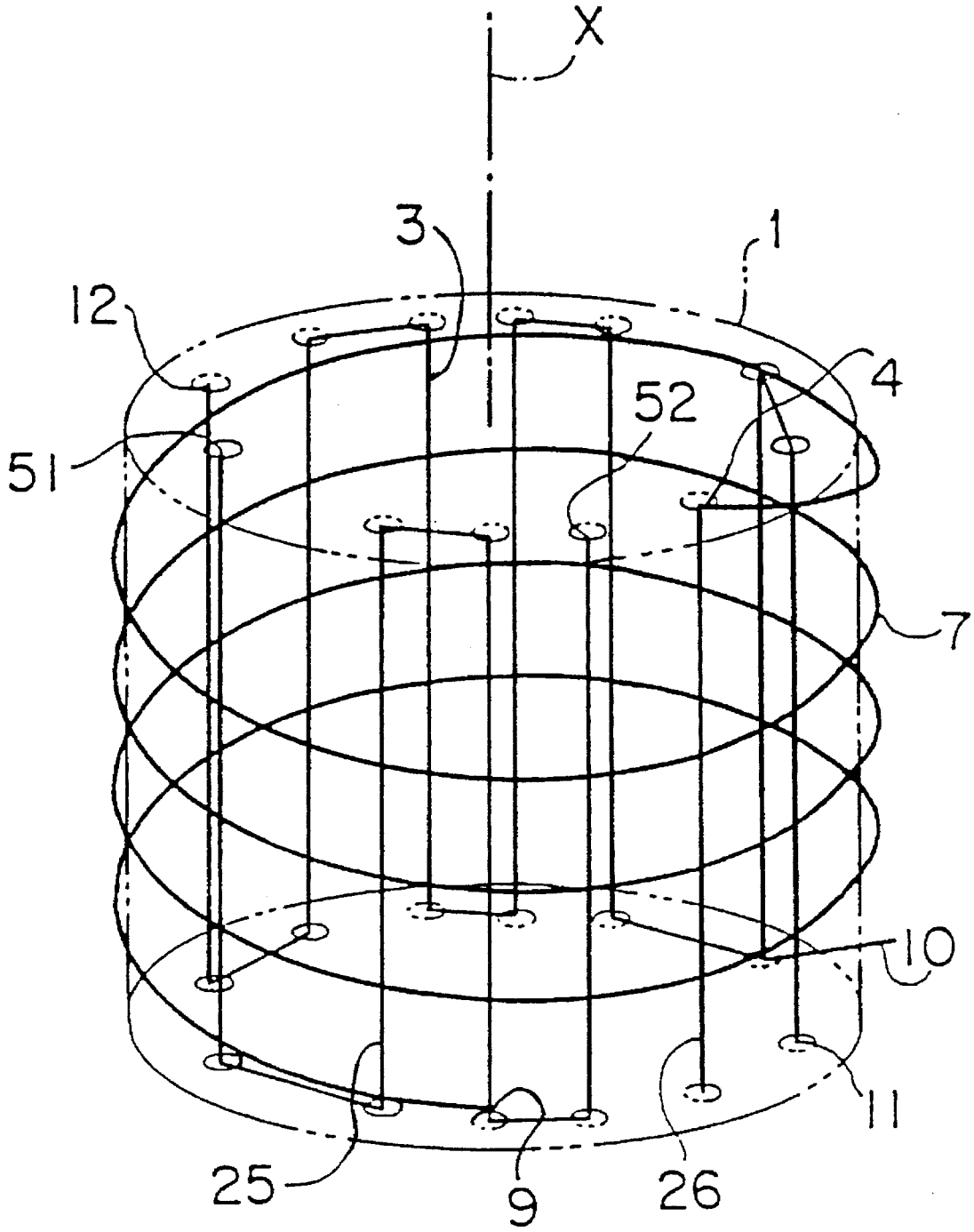
FIG. 11D Is a schematic perspective view showing conductors of the FIG. 11A radio apparatus antenna.

FIGS. 11A to 11C are a top view, a side view and a bottom view of an antenna for radio apparatus according to the ninth embodiment of the invention, respectively. FIG. 1id is a perspective view showing first and second conductors 7 and 3 and two fourth conductors 25 and 26. In these figures, components like those of the previously-described third embodiment shown in FIGS. 5A to 5D are designated by identical reference numerals and will not be described herein. The ninth embodiment differs from the third embodiment in that while in the third embodiment the second conductor 3 as a whole takes the meandering form which completely surrounds the center axis X, the second conductor 3 in the ninth embodiment takes as a whole a meandering form which partially surrounds the center axis X, that the ninth embodiment has the two fourth conductors 25 and 26, and that in the ninth embodiment the first conductor 7 is not electrically connected to the second conductor 3 but is electrically connected at a connecting point 4 to the fourth conductor 26. In the ninth embodiment, the fourth conductor 26 is rectilinear. The fourth conductor 25 having one end at a start point 51 extends along guide holes 2 in sequence thereof to take a meandering form and terminates in the other end at an end point 52. Thus, the fourth conductors 25 and 26 are spaced apart from the first conductor 3. The fourth conductor 25 is not electrically connected to any other conductors. Since in the ninth embodiment the first conductor 7 is not electrically connected to the second conductor 3 having a feeding point 10, the first conductor 7 does not act as an open stub on a portion of second conductor 3 lying between start point 11 and feeding point 10. Therefore, in comparison with the second embodiment, the order of the previously-described double resonance is decreased to narrow the frequency band which satisfies the matching condition. The ninth embodiment, however, has an unfed section (a set of first and fourth conductors 7 and 26 as well as the fourth conductor 25) and the function of this unfed section can be utilized for fine adjustment of the center frequency of the matching frequency band, thereby facilitating the adjustment of center frequency during fabrication.

A tenth embodiment of the invention will now be described with reference to FIG. 12.

Figure 12:
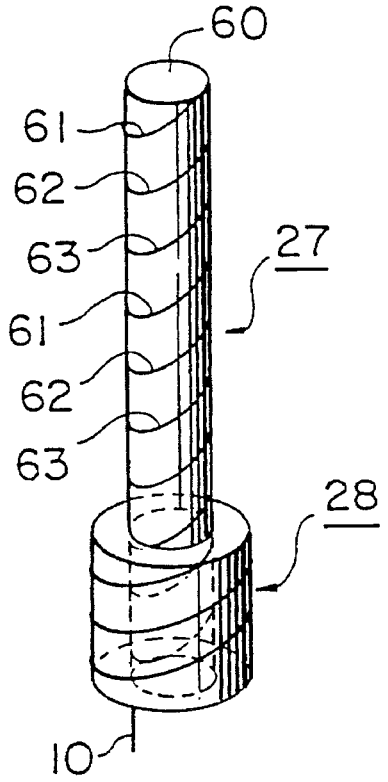
FIG. 12 is a schematic perspective view of an antenna for radio apparatus according to a tenth embodiment of the invention.

FIG. 12 is a schematic perspective view showing an antenna for radio apparatus according to the tenth embodiment of the invention. In FIG. 12, reference numeral 28 designates the radio apparatus antenna of the first embodiment shown in FIGS. 1A to 1D, the radio apparatus antenna of the second embodiment shown in FIGS. 4A to 4C, the radio apparatus antenna of the third embodiment shown in FIGS. 5A to 5D, the radio apparatus antenna of the fifth embodiment shown in FIGS. 7A to 7D, the radio apparatus antenna of the sixth embodiment shown in FIGS. 8A to 8C, the radio apparatus antenna of the seventh embodiment shown in embodiment shown in FIGS. 10A to 10D or the radio apparatus antenna of the ninth embodiment shown in FIGS. 11A to 11D. In FIG. 12, reference numeral 27 designates a helical antenna. The helical antenna 27 includes a columnar dielectric member 60 fitted in the center hole of the dielectric member 1, and conductors 61, 62 and 63 helically wound on the side or circumferential surface of the dielectric member 60 in such a manner that they do not contact with each other. Namely, in the tenth embodiment, the helical antenna 27 has a multi-helical (triple helical in this example) structure. However, the helical antenna may not always be of the multihelical structure and it may be of a mono-helical structure in which a single conductor is wound helically. The helical antenna 27 has a physical length in the center axis direction which is longer than a physical length in the direction of center axis X of the dielectric member 1. In the tenth embodiment, the helical antenna 27 penetrates through the entire length of the center hole in the dielectric member 1 so as to be held in place and it is coupled with the first and second conductors 7 and 3 under the influence of electromagnetic induction. The helical antenna 27 has no feeding point. Since in the tenth embodiment power supplied from the feeding point 10 is radiated to space from a wider surface area defined by the radio apparatus antenna 28 and helical antenna 27, the direction of power radiation is restricted to improve the directional gain and consequently the gain directive of the whole antenna system can advantageously be improved.

Figure 13:
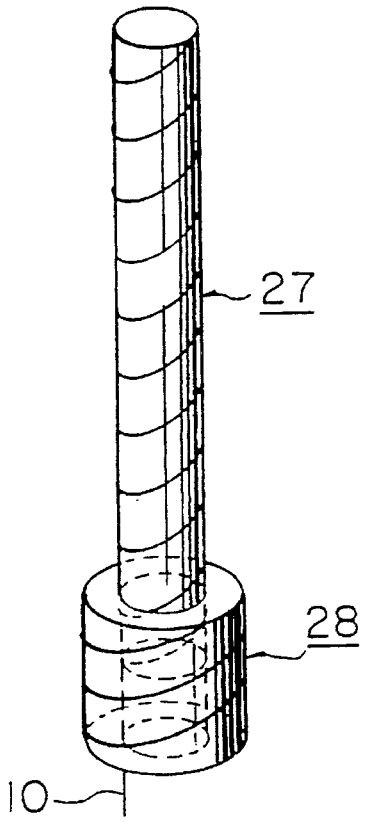
FIG. 13 is a schematic perspective view of an antenna for radio apparatus according to an eleventh embodiment of the invention.

Referring now to FIG. 13, an eleventh embodiment of the invention will be described.

FIG. 13 is a schematic perspective view showing an antenna for radio apparatus according to the eleventh embodiment of the invention. In FIG. 13, components like those of the tenth embodiment shown in FIG. 12 are designated by identical reference numerals and their descriptions will be omitted. The eleventh embodiment differs from the tenth embodiment only in that the helical antenna 27 penetrates through a partial length of the center hole in the dielectric member 1 so as to be held in place. The eleventh embodiment can also attain advantages similar to those obtained with the tenth embodiment.

A twelfth embodiment of the invention together with its fabrication method will now be described with reference to FIGS. 14A to 14F. In these figures, components like those of the foregoing individual embodiments are designated by identical reference numerals.

Figure 14A:
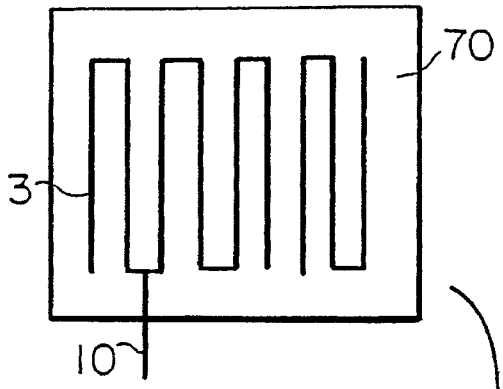
FIGS. 14A to 14F are diagrams showing a fabrication process of an antenna for radio apparatus according to a twelfth embodiment of the invention.
Figure 14B:
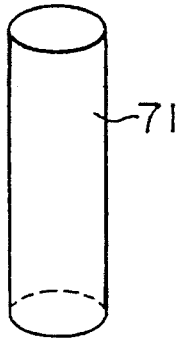
Figure 14C:
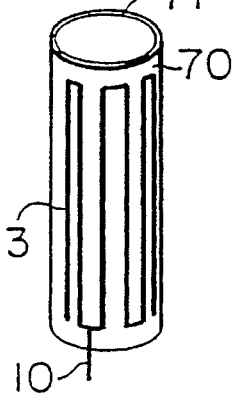
Figure 14D:
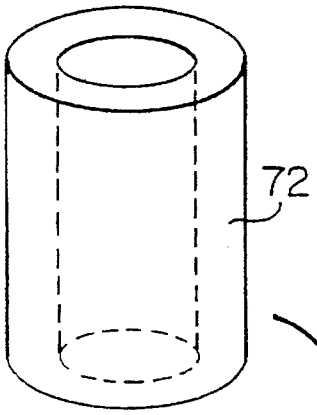
Figure 14E:
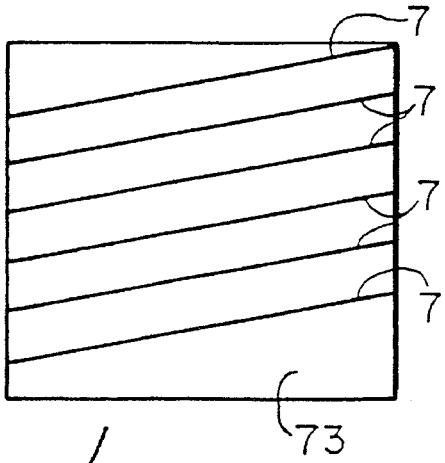
Figure 14F:
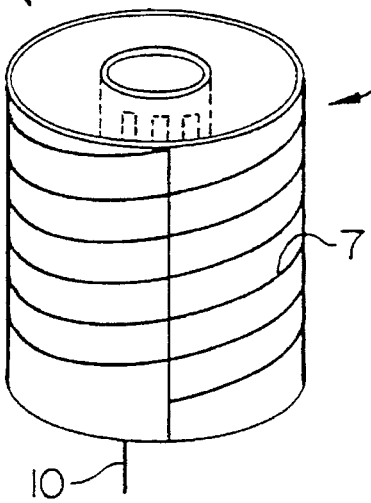

Firstly, a flexible dielectric film 70 as shown in FIG. 14A formed with a printed pattern of a second conductor 3 is prepared. An electrically conductive, thin plate is jointed to the printed pattern to form a feeding point 10. A columnar dielectric member 71 is then prepared. Then, as shown in FIG. 14C, the flexible dielectric film 70 is adhered to the side or circumferential surface of the dielectric member 71. A cylindrical dielectric member 72 as shown in FIG. 14D is prepared. A flexible dielectric film 73 as shown in FIG. 14E formed with a printed pattern of a first conductor 7 is prepared. Subsequently, the dielectric member 71 with the flexible dielectric film 70 is placed in the center hole of the dielectric member 72 and the flexible dielectric film 73 is adhered to the circumferential surface of the dielectric member 72 to complete an antenna for radio apparatus according to the invention as shown in FIG. 14F. Upon adherence of the flexible dielectric film 73, printed patterns of the first conductor 7 are electrically connected to each other in a suitable way. Although not illustrated, a portion of the first conductor 7 is electrically connected to the second conductor 3 in a suitable way. For example, electrically conductive members jointed to the first and second conductors 7 and 3 may be used which bridge upper portions of the first and second conductors 7 and 3 at the top of the FIG. 14F illustration. The radio apparatus antenna of the twelfth embodiment has characteristics similar to those of the third embodiment shown in FIGS. 5A to ED and obviously, it is easy to fabricate. It will be appreciated that in the twelfth embodiment the flexible dielectric films 70, 73 and the dielectric members 71, 72 form a multi-layer structure which corresponds to the previously-described dielectric member 1.

Individual embodiments of the invention have been described but the present invention is in no way limited to the foregoing embodiments.

For example, in the foregoing embodiments, the second conductor 3 is disposed inside of the first conductor 7 but conversely the second conductor 3 may be disposed outside of the first conductor 7. The dielectric member 1 taking the cylindrical or columnar form in the foregoing embodiments may take other forms such as an elliptically cylindrical form, an elliptically columnar form, a prismatically cylindrical form and a prismatic form. In the foregoing embodiments, the first conductor 7 is laid on the outer circumferential surface of the dielectric member 1 but it may be disposed in the dielectric member 1 or may be laid on the inner circumferential surface of the dielectric member. In the foregoing embodiments, the second conductor 3 is disposed in the dielectric member 1 but it may be laid on the outer or inner circumferential surface of the dielectric member 1. In the foregoing embodiments, the fourth conductor is excluded when the first conductor 7 is electrically connected to the second conductor 3 but even in such a case, the fourth conductor may he included. In the foregoing embodiments, with the third conductor 6 included when the first conductor 7 is electrically connected to the second conductor 3, the third conductor 6 is electrically connected to the second conductor 3 but even in such a case, the third conductor 6 may electrically insulated from any other conductors.

As described above, the present invention can achieve good impedance matching with the exciting source without using any separate matching circuit and therefore can promote miniaturization of the whole antenna system and ensure reduction in cost.

Further embodiments of the present invention will now be described.

Figure 15:
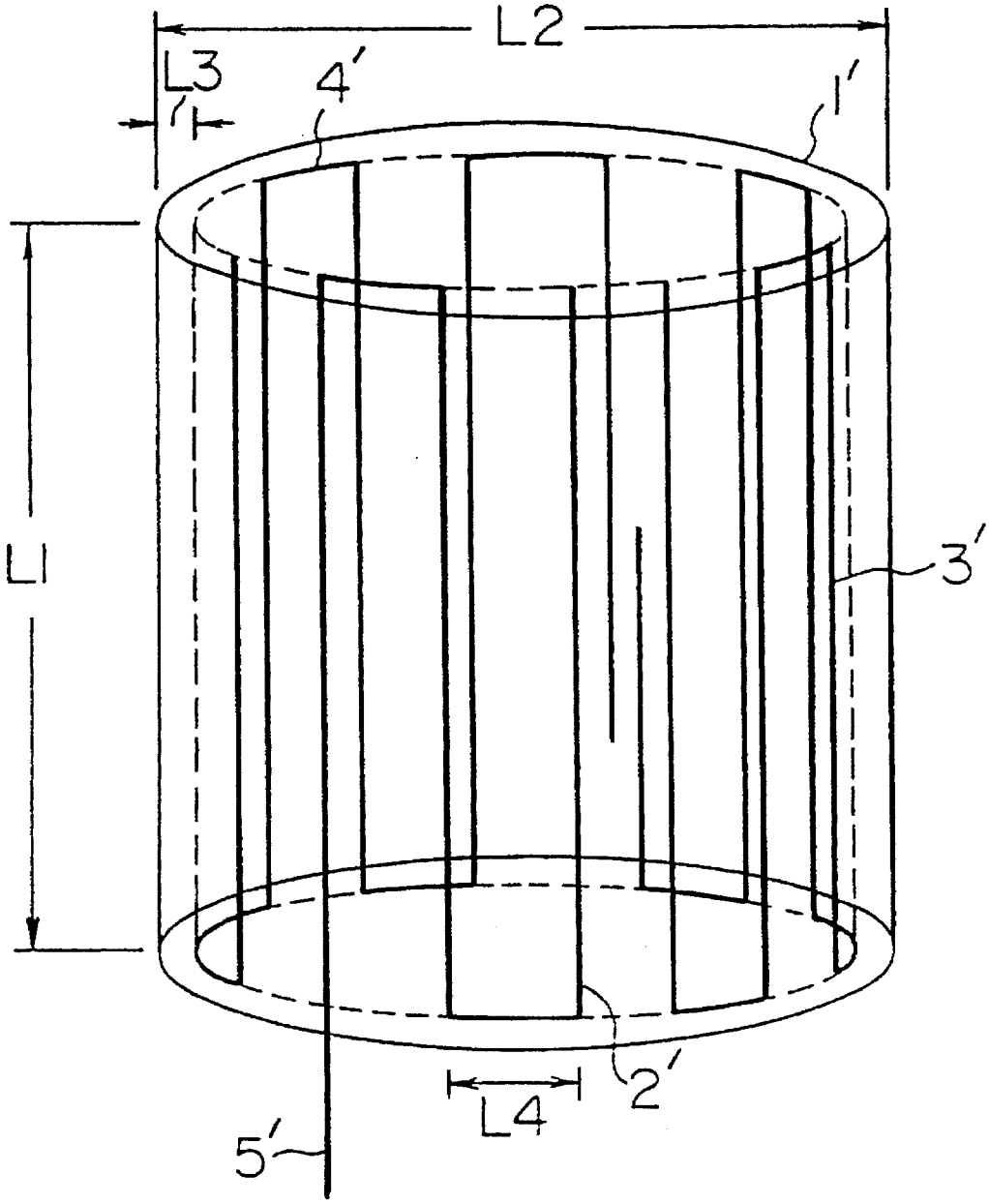
FIG. 15 is a perspective view of a thirteenth embodiment of the antenna of small size for the portable receiver according to the present invention.

FIG. 15 is a perspective view of a fourteenth embodiment of the antenna of small size for the portable receiver according to the present invention.

Referring to FIG. 15, a first meander conductor 2' that is an exciting conductor having a feeding point 5' is formed in a solid cylinder 1' of a dielectric material together with a second meander conductor 3' and a third meander conductor 4'. The meander conductors 3' and 4' are not directly electrically connected to the meander conductor 2' and are excited by electromagnetic induction. These meander conductors 2', 3' and 4' are formed on the same virtual cylindrical surface formed by a closed curved plane having the equal distance from the central axis of the solid cylinder 1'. When the second meander conductor 3' and the third meander conductor 4' are selected to have respectively different electric lengths suitable for making resonance in the frequency range (0.9 GHz to 1.5 GHz) used by a receiver to which the antenna of the present invention is applied, these meander conductors 3' and 4' are excited with a substantially equivalent degree of electromagnetic coupling, and double resonance is achieved in the frequency range used by the receiver. Also, a very wide and satisfactory input impedance matching condition is achieved. Further, the antenna can very efficiently radiate output power from the receiver without the necessity for separately providing a matching circuit.

It is apparent that the ratio between the illustrated sizes of the individual members forming all of antennas shown in the drawings including FIG. 15 differs from that between the actual sizes. In the drawings, the ratio is suitably enlarged or reduced so as to facilitate the understanding of the structure of the antenna. In the fourteenth embodiment of the antenna shown in FIG. 15, the relative dielectric constant ($\epsilon\gamma$) of the dielectric solid cylinder 1' is about 3 to 5, and $L1 \leqq 20$ to 30 mm, $L2 \approx 6$ mm, $L3 \approx 0.8$ mm and $L4 \approx 1$ to 2 mm. the entire length of the meander conductor 2 is about $\lambda/4$, while the entire length of each of the meander conductors 3'and 4' is selected to be about $\lambda/2$. Part of the meander conductor 2' extending in the perpendicular direction of the hollow cylinder and having the feeding point 5' on its extension and part of the meander conductor 4' extending in the perpendicular direction of the hollow cylinder are spaced apart from each other by a distance that is a minimum required for excitation by means of electromagnetic coupling. (This distance is about 0.8 mm to 1.0 mm when the frequency band used by the receiver is 0.9 GHz to 1.5 GHz.) Also, another part of the meander conductor 2' extending in the perpendicular direction of the hollow cylinder and part of the meander conductor 3' extending in the perpendicular direction of the hollow cylinder are similarly spaced apart from each other by a distance that is a minimum required for excitation by means of electromagnetic coupling.

Figure 16:
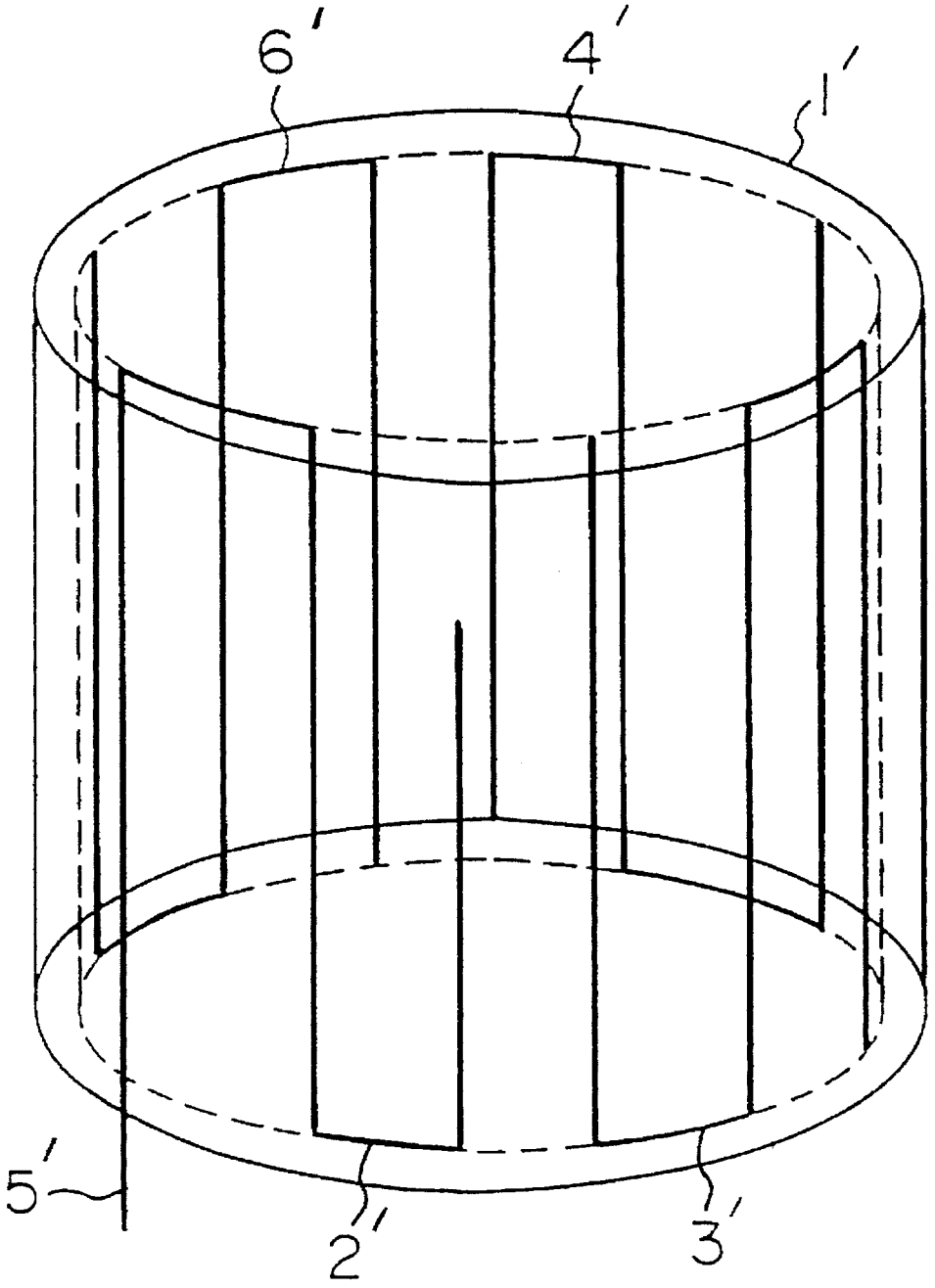
FIG. 16 is a perspective view of a fourteenth embodiment of the antenna of small size for the portable receiver according to the present invention.

FIG. 16 is a perspective view of a fourteenth embodiment of the antenna of small size for the portable receiver according to the present invention. The antenna shown in FIG. 16 differs from that shown in FIG. 15 in that a fourth conductor 6 which does not make direct electrical contact with other conductors is present in a dielectric solid cylinder 1'. This fourth conductor 6' is excited with a degree of electromagnetic coupling substantially equivalent to that for a second conductor 3' and a third conductor 4'. Therefore, when the electric length of this fourth conductor 6' is selected to resonate in the frequency range used by the receiver and differs from those of the second and third conductors 3' and 4', this second embodiment of the antenna exhibits multiple resonance of a degree higher than that of the first embodiment of the antenna and establishes a further satisfactory input impedance matching condition. Also, the frequency range of the receiver is further widened, and the antenna can more efficiently radiate output power from the receiver, so that the frequency band can b widened. The individual meander conductors 2', 3', 4' and 6' are spaced apart from each other by a distance that is a minimum required for excitation by means of electromagnetic coupling with the adjacent meander conductor respectively. (This distance is about 0.8 mm to 1.0 mm when the frequency band used by the receiver is 0.9 GHz to 1.5 GHz). Further, the electric length of the fourth meander conductor 6' is selected to be about $\lambda/2$, as in the case of meander conductors 3' and 4'.

Figure 17:
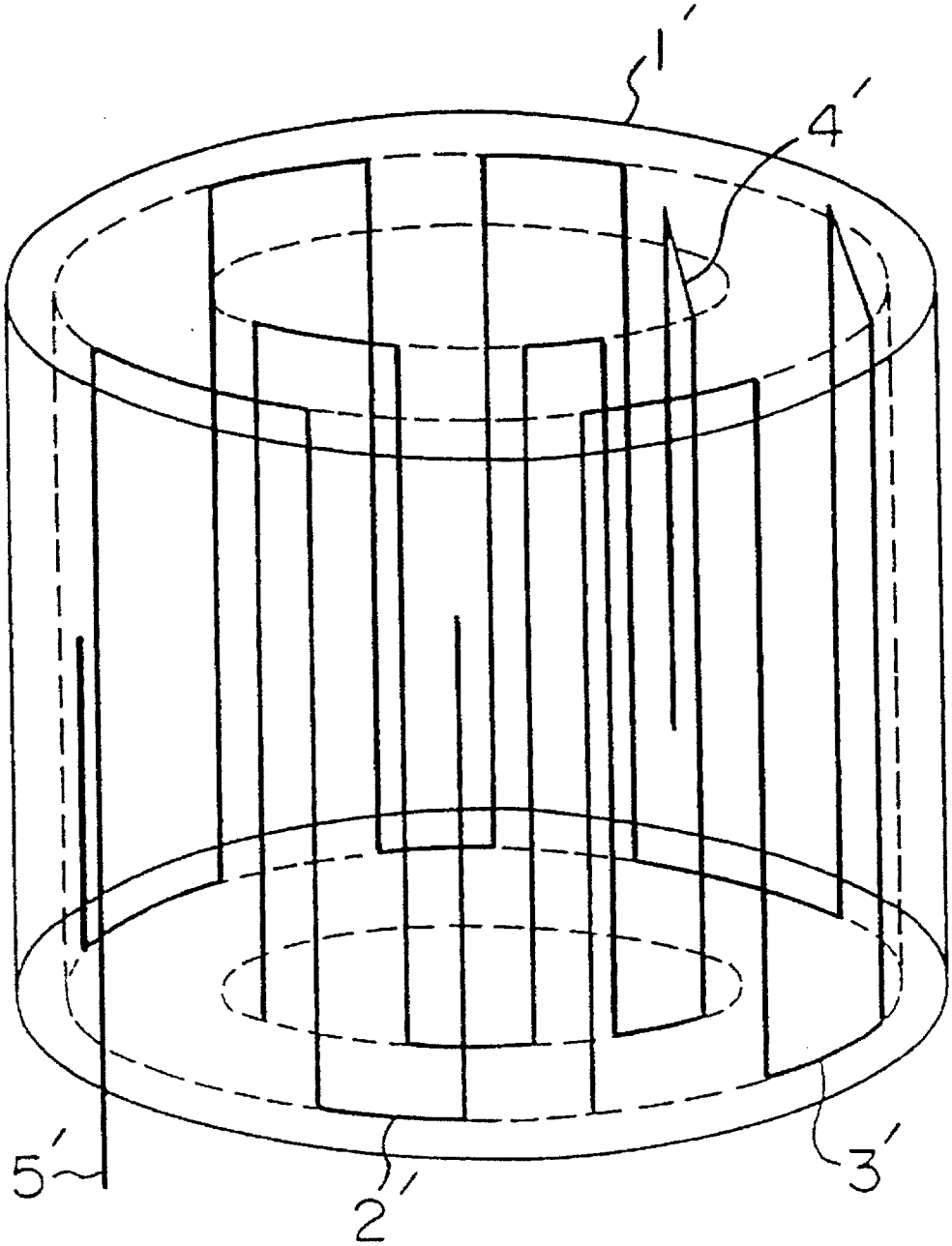
FIG. 17 is a perspective view of a fifteenth embodiment of the antenna of small size for the portable receiver according to the present invention.

FIG. 17 is a perspective view of a fifteenth embodiment of the antenna of small size for the portable receiver according to the present invention. The fifteenth embodiment of the antenna differs from the thirteenth embodiment shown in FIG. 15 in that a solid cylinder 1' of a dielectric material includes two different virtual cylinders each of which is formed of a closed curved plane having an equal distance from the central axis and that a third conductor 4' is formed on the surface of the inner virtual cylinder. In this fifteenth embodiment, the dielectric space for accommodating the conductors having their electric lengths for producing resonance in the frequency range used by the receiver equivalently increases as compared to that of the thirteenth embodiment, so that the size of the antenna can be made smaller. In this fifteenth embodiment too, individual meander conductors 2', 3' and 4' are spaced apart from each other by a distance that is a minimum required for making excitation by means of electromagnetic coupling with the adjacent meander conductor. (This distance is about 0.8 mm to 1.0 mm.)

Figure 18:
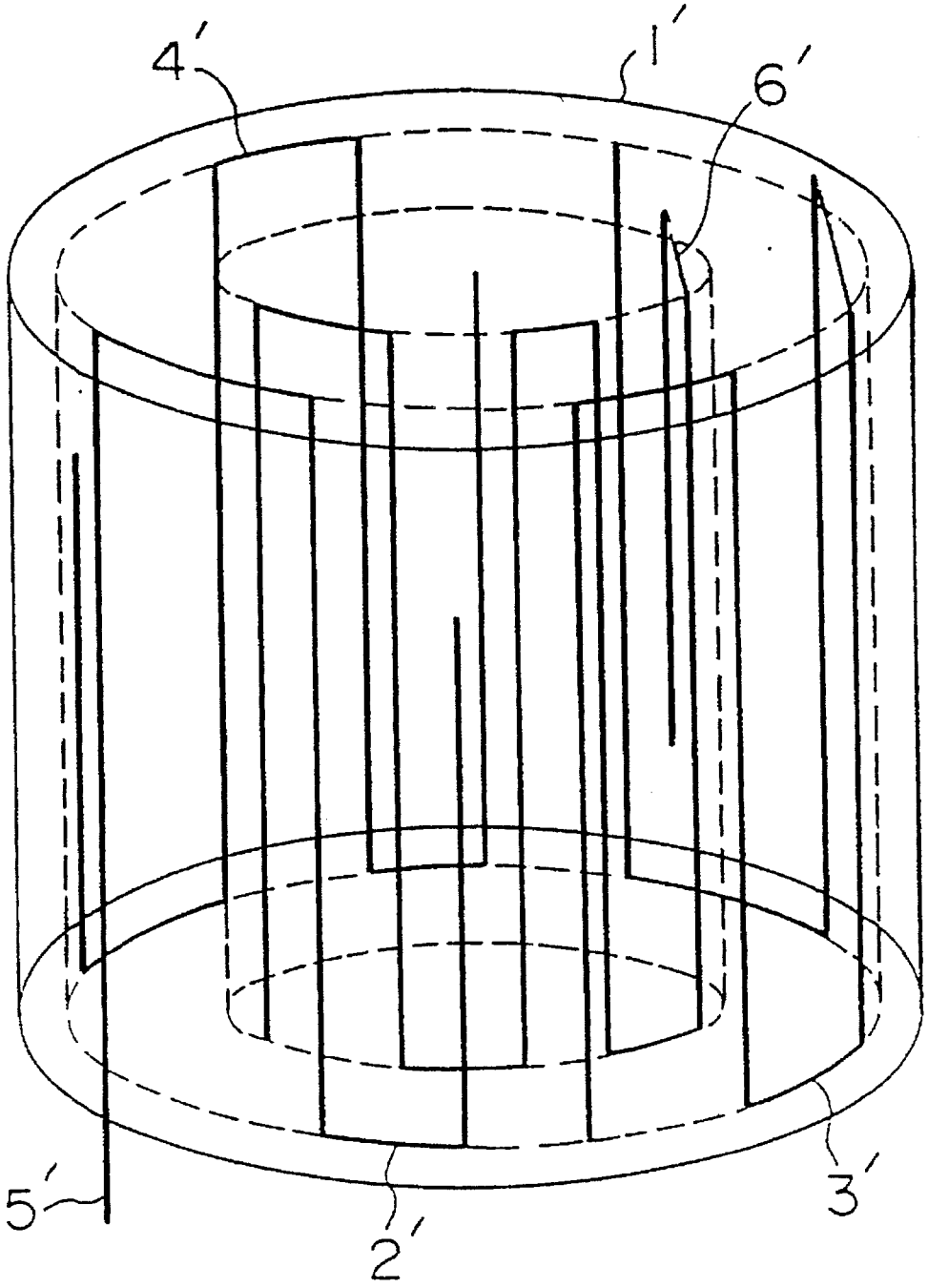
FIG. 18 is a perspective view of a sixteenth embodiment of the antenna of small size for the portable receiver according to the present invention.

FIG. 18 is a perspective view of a sixteenth embodiment of the antenna of small size for the portable receiver according to the present invention. This sixteenth embodiment differs from the fourteenth embodiment shown in FIG. 16 in that a dielectric solid cylinder 1' includes two different virtual cylinders each of which is formed of a closed curved plane having an equal distance from the central axis, and that a fourth conductor 6' is formed on the inner virtual cylinder. In this sixteenth embodiment, the dielectric space including the electric lengths resonating in the frequency range used by the receiver equivalently increases as compared to the fourteenth embodiment, so that the size of the antenna can be made smaller. In this case too, individual meander conductors 2', 3', 4' and 6' are spaced apart from each other by a distance (about 0.8 mm to 1.0 mm) that is a minimum required for making excitation by means of electromagnetic coupling with the adjacent meander conductor.

Figure 19:
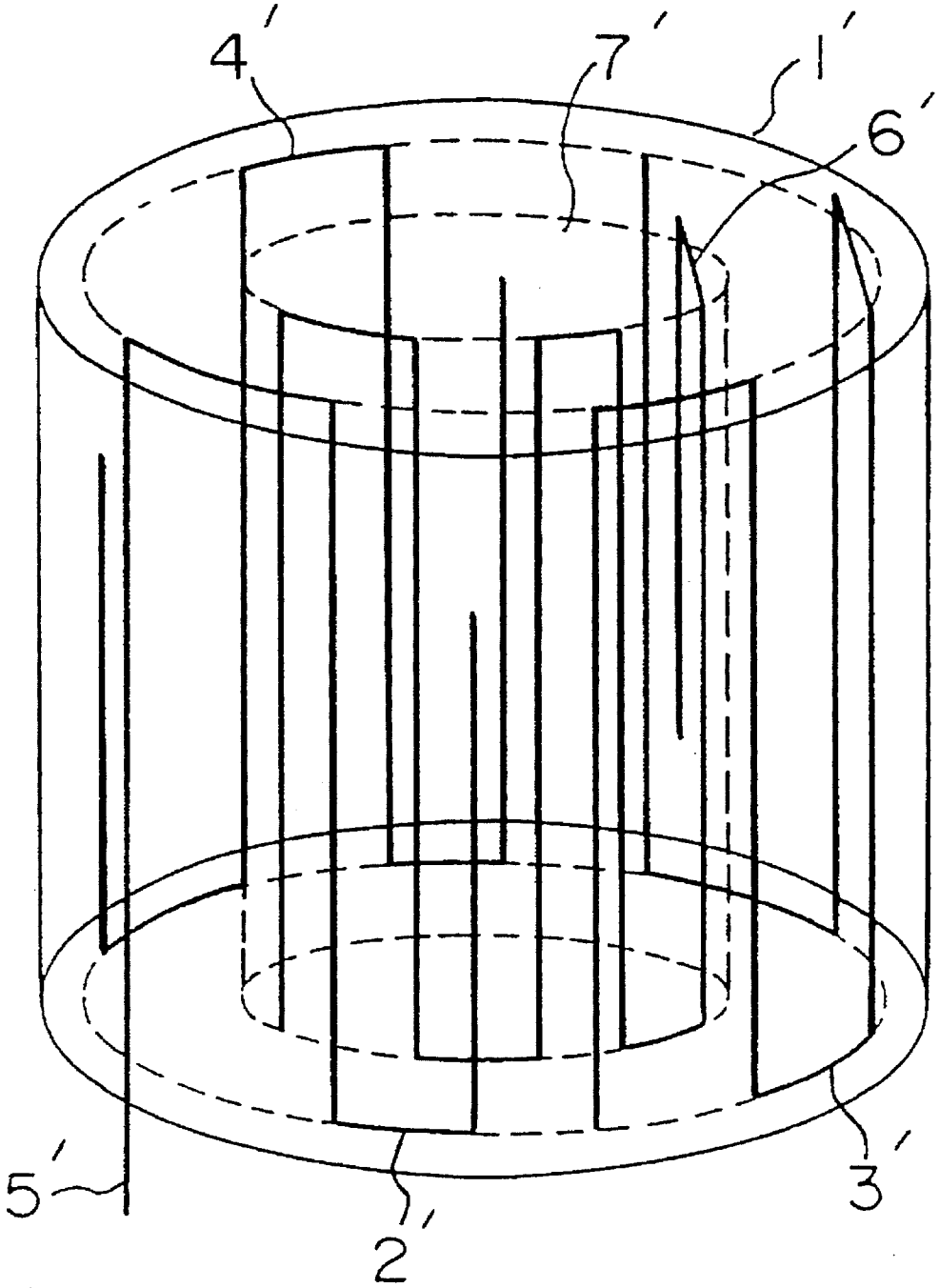
FIG. 19 is a perspective view of a seventeenth embodiment of the antenna of small size for the portable receiver according to the present invention.

FIG. 19 is a perspective view of a seventeenth embodiment of the antenna of small size for the portable receiver according to the present invention. This seventeenth embodiment differs from the sixteenth embodiment shown in FIG. 18 in that a dielectric solid cylinder 7' having a dielectric constant different from that of a dielectric solid cylinder 1' is formed in the solid cylinder 1' in such a relation that the boundary between them is a virtual cylindrical surface on which a fourth conductor 6' is formed. The relative dielectric constant ($\epsilon\gamma$) of the dielectric solid cylinder 7' is desirably lower than 2.1. Theoretically, it is ideal that a dielectric material having a relative dielectric constant of 1 is to be used for the formation of the dielectric solid cylinder 7'. However, in view of the fact that the material having the relative dielectric constant of about 1 is quite expensive, it is preferable to employ a dielectric material having a relative dielectric constant of about 2.1 when the cost performance is taken into consideration. This seventeenth embodiment is advantageous in that, because the electric length of the fourth conductor 6' can be suitably adjusted by the dielectric constants of the plural dielectrics, the degree of freedom of design increases thereby facilitating the design. In view of the fact that the use of a material having a high dielectric constant leads commonly to a large electric loss, the undesirably power loss can be minimized by lowering the value of the dielectric constant at the central area of the solid cylinder 1' where the radio wave concentrates. Further, when another dielectric is similarly formed on the other side of the boundary that is the virtual cylindrical surface where first, second and third conductors 2' 3' and 4' are formed, the electric lengths of the first, second and third conductors 2', 3' and 4' can be adjusted by the dielectric constant of the dielectric. It will be easily presumed that, in such a case, the degree of freedom of design increases thereby facilitating the design.

Figure 20:
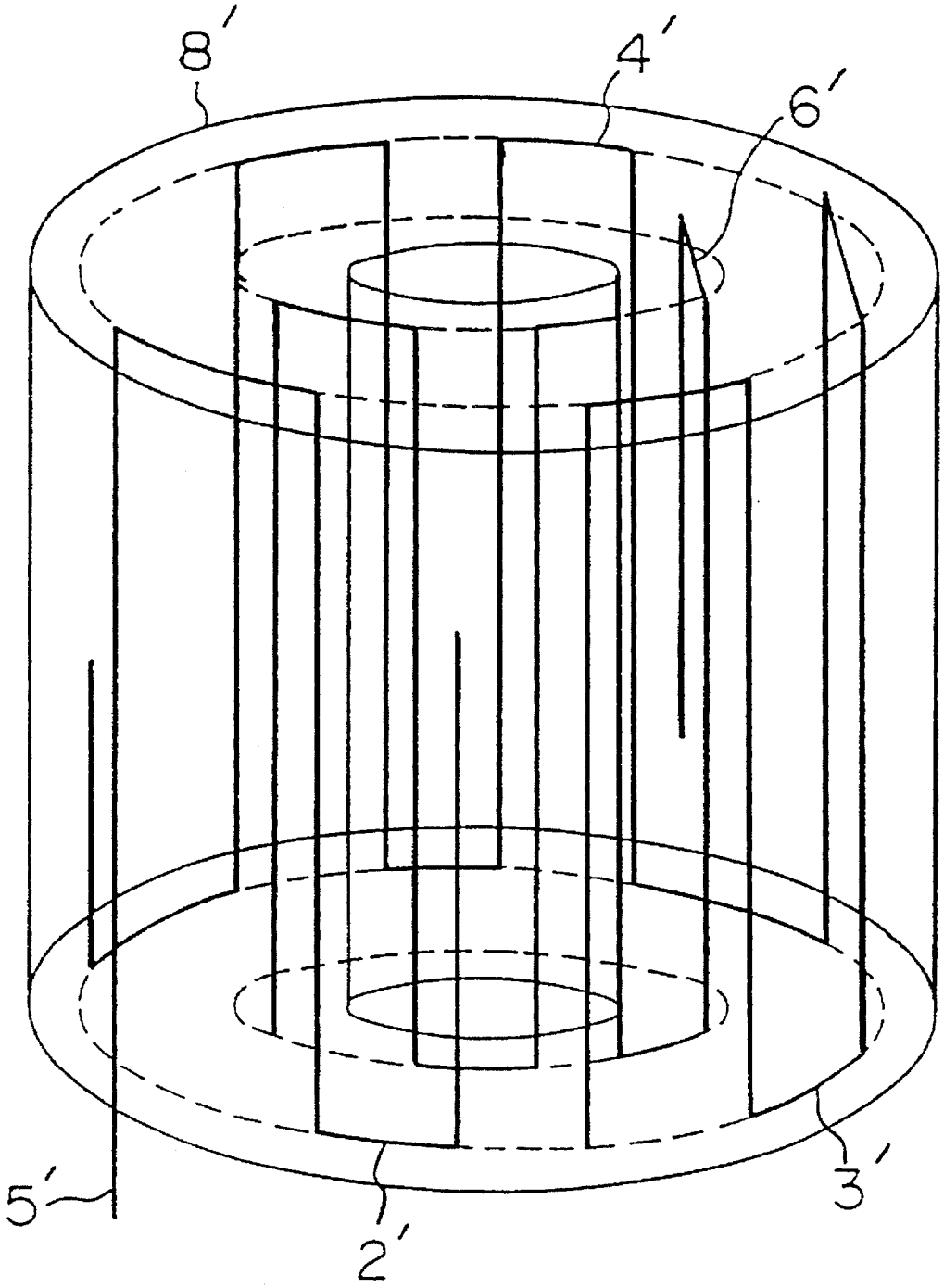
FIG. 20 is a perspective view of an eighteenth embodiment of the antenna of small size for the portable receiver according to the present invention.

FIG. 20 is a perspective view of an eighteenth embodiment of the antenna of small size for the portable receiver according to the present invention. This eighteenth embodiment differs from the sixteenth embodiment shown in FIG. 18 in that the dielectric material is partly removed in an area inside of a virtual cylindrical surface where a fourth conductor 6' is formed, and, as a result, first, second, third and fourth conductors 2', 3', 4' and 6' are formed in a hollow cylinder 8 having a corresponding thickness. In this eighteenth embodiment, the part of the dielectric material which does not substantially participate in the adjustment of the electric lengths of the conductors is removed. Thus, this embodiment is effective for reducing the weight of the antenna, and this is preferable for improving the portability of the receiver.

Figure 21A:
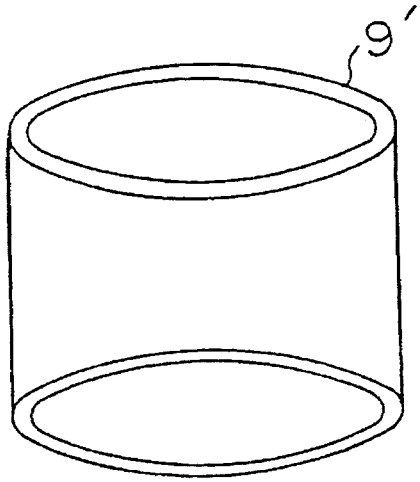
FIGS. 21A to 21D are perspective views showing the process for manufacturing the antenna of small size for the portable receiver according to the present invention.
Figure 21B:
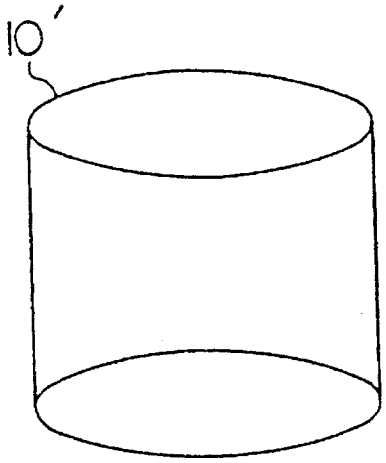
Figure 21C:
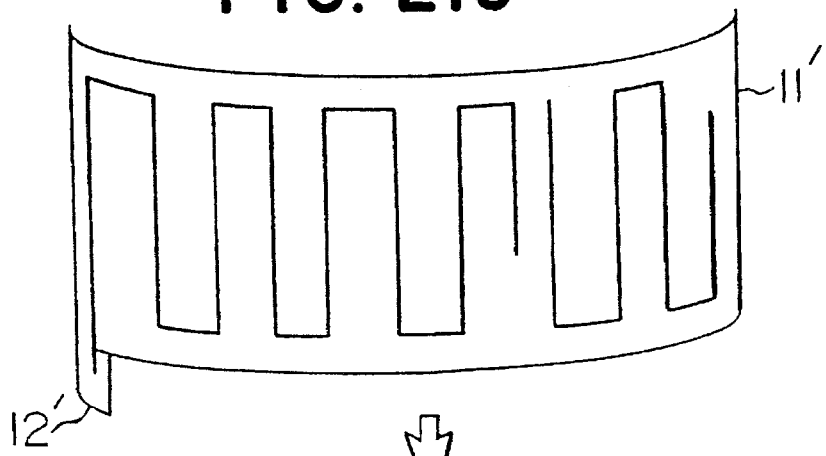
Figure 21D:
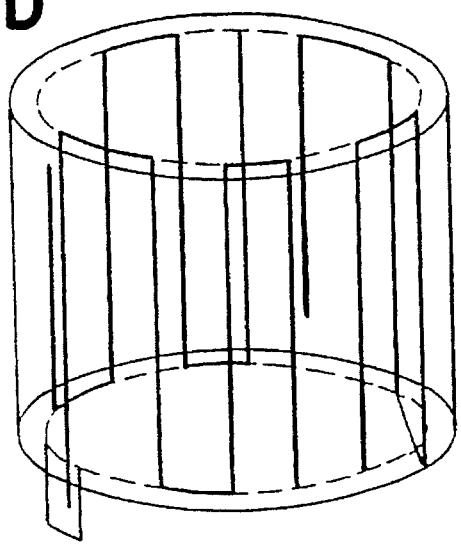

FIGS. 21A to 21D are perspective view showing the process for manufacturing the antenna of small size for the portable receiver according to the present invention. Referring to FIGS. 21A and 21B, a dielectric hollow cylinder 9' and a dielectric solid cylinder 10' having different dielectric constants or the same dielectric constant are sized so that the former contains the latter therein with a suitable small clearance between them. The conductors including the first, second and third conductors 2', 3' and 4' are printed in an illustrated print pattern 11' on a dielectric film as shown in FIG. 21C, and the clearance is utilized to insert the dielectric film between the dielectric hollow cylinder 9' and the dielectric solid cylinder 10'. A feeding point 12' is provided beforehand on an externally protruding end of the print pattern 11', so that it can be used as the feeding point 5' described already. Therefore, the antenna of small size shown in FIG. 21D for the portable receiver can be mass-produced. On the other hand, in accordance with another approach, the antenna may be manufactured as a unitary body. That is, instead of using a print pattern, conductors are buried in the dielectric hollow cylinder.

Figure 22:
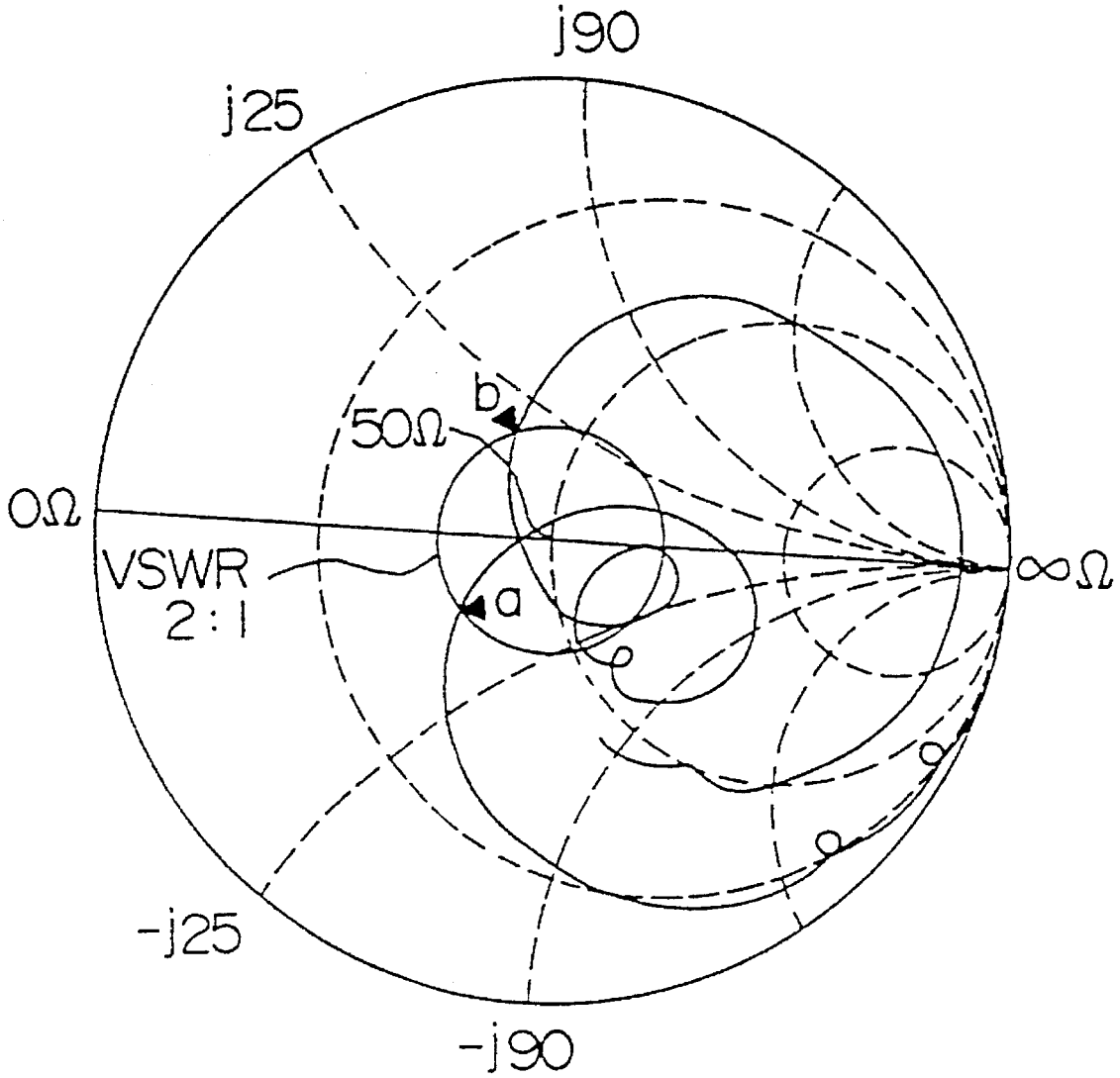
FIG. 22 is a Smith chart plot of the driving point impedance of the meander antenna of the present invention.

FIG. 22 is a Smith chart plot to illustrate how the fifteenth embodiment of the antenna of small size for the portable receiver according to the present invention has an electrical property matching with that of the radio frequency section of the receiver. Because, in the cellular system now in use, different frequency bands are used for the signal reception and transmission, an unnecessary frequency band called the guard band exists between the respective frequency bands. Therefore, it will be understood from FIG. 22 that, except the guard band that is the unnecessary frequency band, the state of satisfactory matching where the VSWR (voltage standing wave ratio) is 2:1 can be realized in the frequency range between the point a and the point b. The frequencies at the points a and b are 800 MHz and 900 MHz, respectively, and the center frequency is 850 MHz. Therefore, the bandwidth of the matching range is 12%, and it will be seen that the antenna thus obtained has a very wide frequency band.

It will be seen from the aforementioned embodiments of the present invention that the antenna that can satisfy the required satisfactory state of matching with the radio frequency part of the receiver in a very wide frequency band without the necessity for separately providing a matching circuit can be constructed to be suitable for mass production. Therefore, the antenna of small size for the portable receiver can be offered at a low price.

Various embodiments of the antenna suitable for use in a portable receiver of small size having a casing whose maximum size is less than ¼ of the radio wavelength used by the receiver will now be described by reference to FIGS. 23 and 26.

Figure 23:
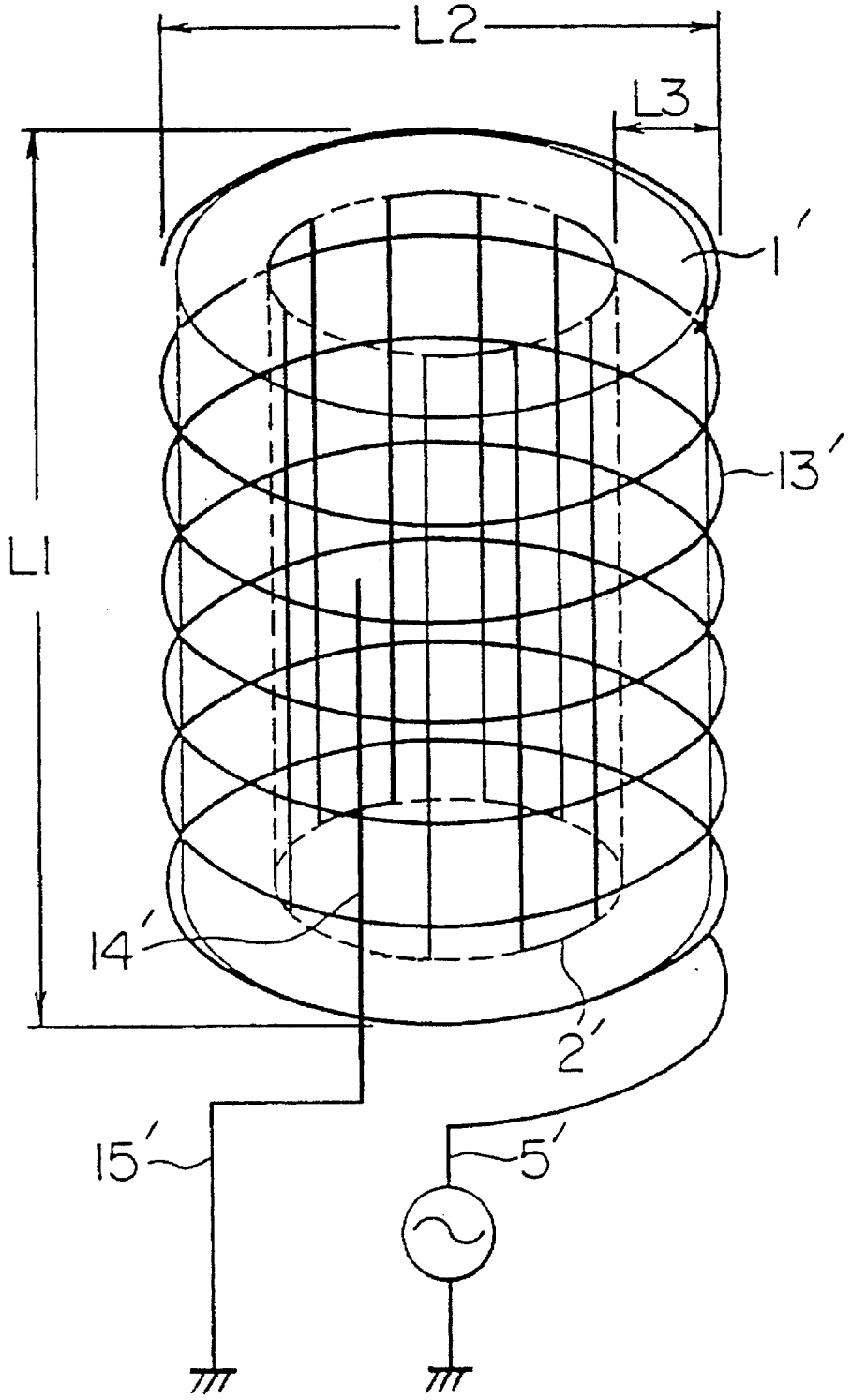
FIG. 23 is a perspective view of a nineteenth embodiment of the antenna of small size for the portable receiver according to the present invention.

FIG. 23 is a perspective view showing a nineteenth embodiment of the antenna of small size for the portable receiver according to the present invention.

Referring to FIG. 23, a helical conductor 13' that is an exciting conductor having a feeding point 5' is wound around the surface of a dielectric solid cylinder 1'. In this dielectric solid cylinder 1', a meander conductor 2' is formed on the surface of a virtual cylinder formed by a closed curved plane having an equal distance from the central axis of the solid cylinder 1'. The meander conductor 2' is not directly electrically connected to the helical conductor 13' and is excited by the electromagnetic induction. Further, another conductor 14' enclosed by the helical conductor 13' and connected at a grounding point 15' to the ground potential of the receiver is formed in the dielectric solid cylinder 1'. The length (the electric length) of the helical conductor 13' existing on the surface of the dielectric solid cylinder 1' is selected to resonate in the frequency range used by the receiver to which the present invention is applied. Further, the electric length of the meander conductor 2' is selected to resonate with a frequency different from that of the helical conductor 13' in the frequency range used by the receiver. With the electric lengths of both the conductors 2' and 13' are so selected, these conductors 2' and 13' are excited by means of electromagnetic coupling, so that double resonance occurs in the frequency range used by the receiver. Thus, a very wide and satisfactory output impedance matching condition is established, and the antenna thus obtained can very efficiently radiate output power from the receiver without the necessity for separately providing a matching circuit. When the maximum size of the casing of the receiver under operation is sufficiently large (more concretely, when this maximum size is greater than ¼ of the wavelength used by the receiver), the third conductor 14' need not be grounded. However, when the maximum size of the casing of the receiver under operation is less than ¼ of the wavelength used by the receiver, the third conductor 14' is to be grounded so as to compensate the current components appearing in the vicinity of the feeding point 5' without substantially contributing to radio wave radiation or increasing the gain of the antenna. As a result, the value of the antenna input impedance can be decreased, so that the desired matching with the radio frequency part of the receiver can be achieved.

In this nineteenth embodiment, the height L1 and the diameter L2 of the dielectric solid cylinder 1' are about 21.7 mm and about 8.5 mm, respectively, the spacing L3 between the helical conductor 13' and the meander conductor 2' is about 0.8 mm, and the spacing L4 between the helical conductor 13' and the grounding conductor 15' is also about 0.8 mm. The relative dielectric constant ($\epsilon\gamma$) of the dielectric solid cylinder 1' is 3 to 5. The meander conductor 2' is first printed on a dielectric film, and this film is wound around an inner dielectric hollow cylinder to be disposed on the latter cylinder as described already by reference to FIG. 21.

Figure 24:
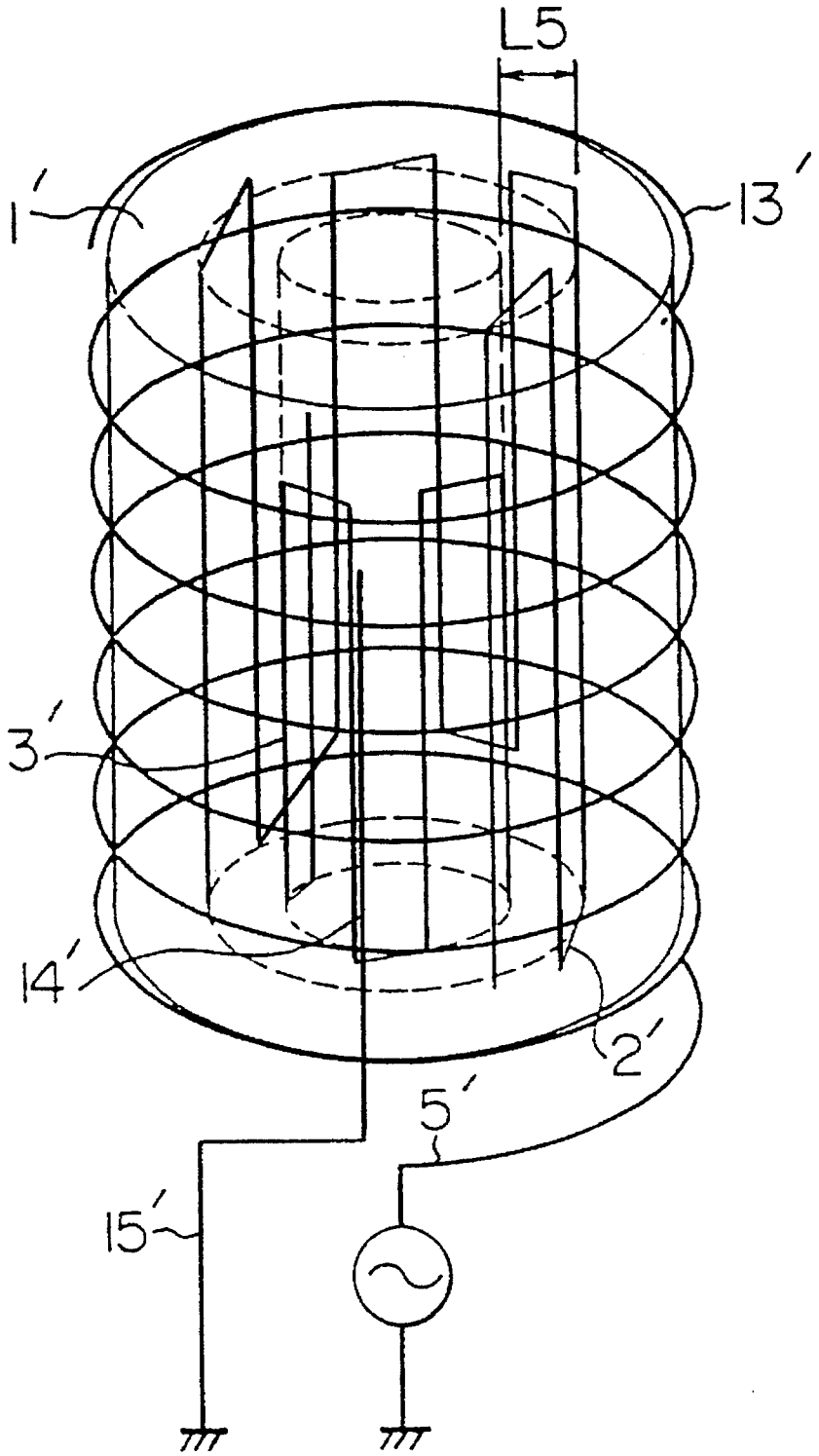
FIG. 24 is a perspective view of a twentieth embodiment of the antenna of small size for the portable receiver according to the present invention.

FIG. 24 is a perspective view of a twentieth embodiment of the antenna of small size for the portable receiver according to the present invention. This embodiment shown in FIG. 24 differs from the embodiment shown in FIG. 23 in that a meander conductor 3' making no direct electrical contact with other conductors is enclosed by a helical conductor 13' in a dielectric solid cylinder 1'. The meander conductor 3' is similar to a meander conductor 2' in that it is also excited by means of electromagnetic coupling. Therefore, when the electric length of the meander conductor 2' and that of the meander conductor 3' are selected to be different from each other, and these conductors 2' and 3' resonate in the frequency range used by the receiver, multiple resonance of higher order than that of the seventh embodiment can be produced. Further, the frequency range establishing the satisfactory matching condition can be widened more, and the output power from the receiver can be efficiently radiated in the wider frequency band. The spacing L5 between the meander conductors 2' and 3' is about 0.8 mm.

Figure 25:
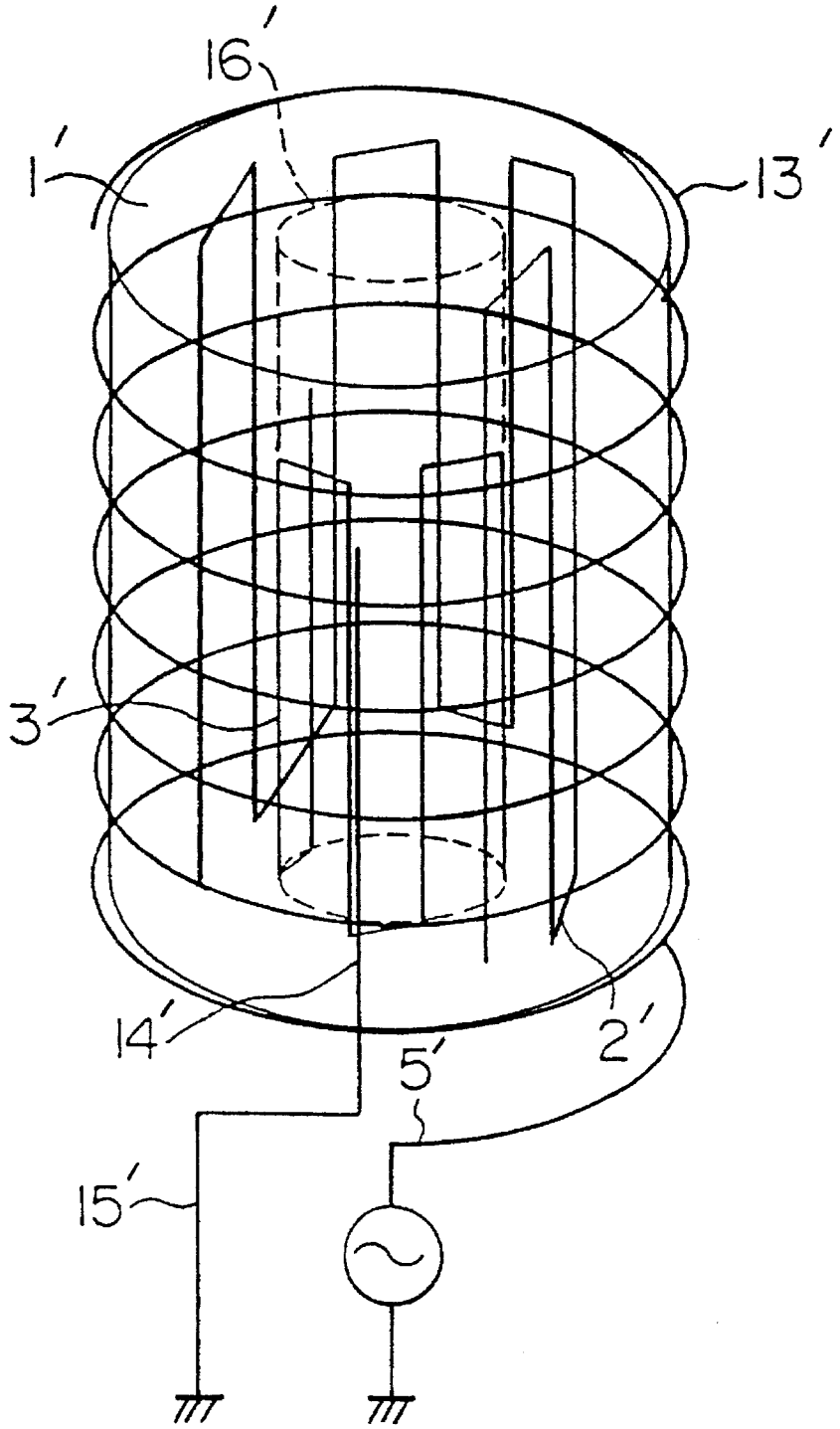
FIG. 25 is a perspective view of a twenty-first embodiment of the antenna of small size for the portable receiver according to the present invention.

FIG. 25 is a perspective view of a twenty-first embodiment of the antenna of small size for the portable receiver according to the present invention. This embodiment differs from the embodiment shown in FIG. 24 in that a dielectric solid cylinder 16' having a dielectric solid cylinder 1' is formed in the cylinder 1', and a meander conductor 3' is formed on a virtual cylindrical surface at the boundary between these solid cylinders 1' and 16'. The relative dielectric constant of this dielectric solid cylinder 16' is selected to be less than about 2.1.

The dielectric constant is not necessarily changed at the virtual cylindrical surface where the meander conductor 3' is formed. The dielectric constant may be changed at another virtual cylindrical surface. This embodiment is advantageous in that the electric length of the meander conductor 3' can be adjusted by the dielectric constants of the plural dielectrics, so that the degree of freedom of the design increases thereby facilitating the design.

Figure 26:
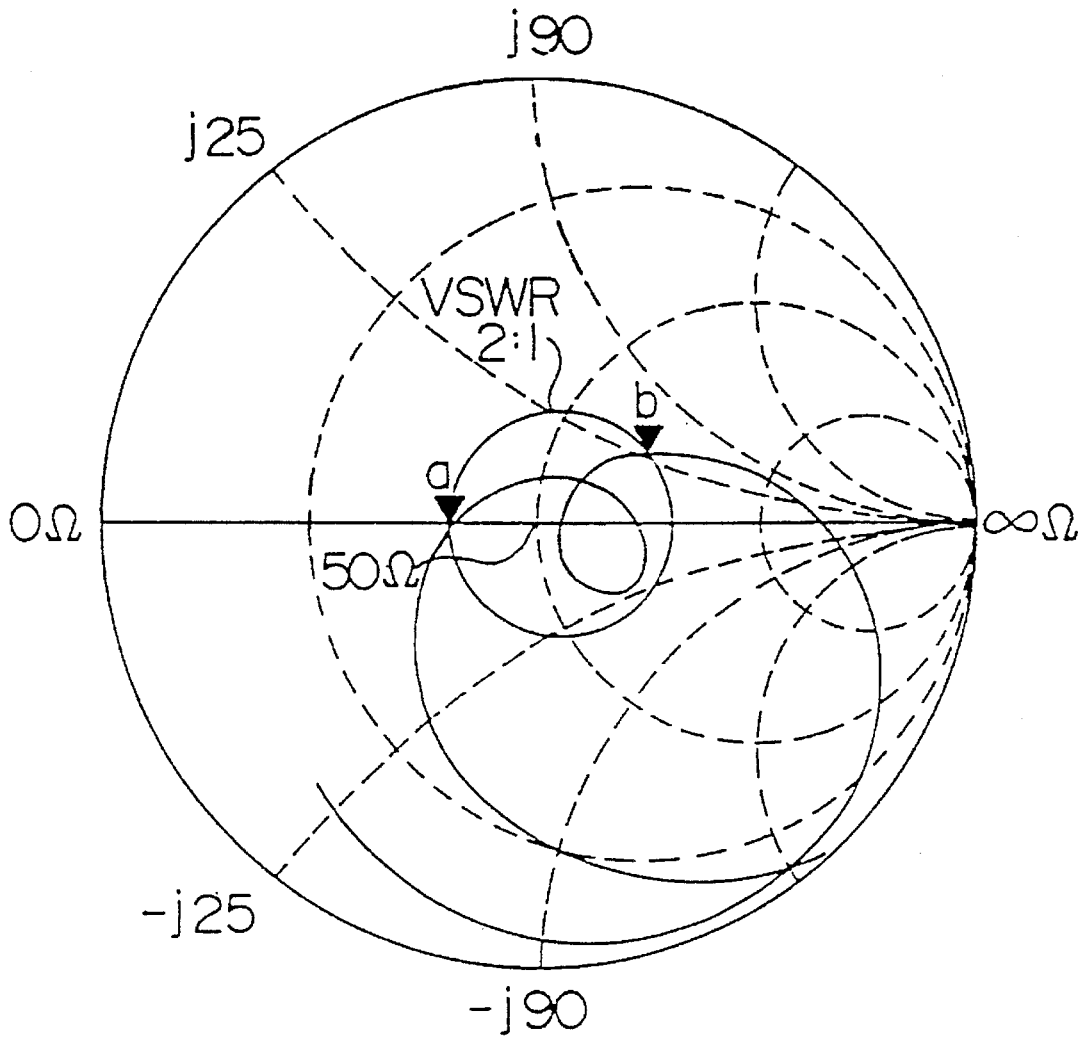
FIG. 26 is a Smith chart plot of the driving point impedance of the antenna represented by FIG. 3 of the present invention.

FIG. 26 is a Smith chart plot to illustrate how the twenty-first embodiment of the antenna of small size for the portable receiver according to the present invention has an electrical property matching with that of the radio frequency part of the receiver. It will be understood from FIG. 26 that the state of satisfactory matching where the VSWR (voltage standing wave ratio) is 2:1 can be realized in the frequency range between the point a and the point b. The frequencies at the points a and b are 1.7 GHz and 1.9 GHz, respectively, and the center frequency is 1.8 GHz. Therefore, the bandwidth of the matching range is 11%, and it will be seen that the antenna thus obtained has a very wide frequency band.

According to the aforementioned nineteenth to twenty-first embodiments, the antenna that satisfies the desired state of matching with the radio frequency part of the receiver in a very wide frequency band without requiring a separately provided matching circuit can be mass-produced while merely requiring a simple step of adjustment. Therefore, the antenna of small size for the portable receiver can be offered at a low price.

In the aforementioned nineteenth to twenty-first embodiments, the conductor 14' having the ground potential is provided for the reason which will be described now. When the maximum size of the casing of the receiver under operation is less than ¼ of the wavelength used by the receiver, the impedance of the antenna input part is higher than that of the radio frequency part of the receiver, and it becomes difficult to produce multiple resonance in the frequency band used by the receiver. Therefore, in the aforementioned nineteenth to twenty-first embodiments, the conductor 14' having its potential equivalent to the ground potential of the receiver is formed in the helical antenna 13', so that the excitation potential for the helical conductor becomes equivalently close to the ground potential. As a result, the characteristic impedance ($Z_0^2$=L/C) contributing to the real part of the impedance of the antenna input part decreases with the increase in the capacitance component (c) because of the closer relation between the excitation potential and the ground potential, and, consequently, the impedance of the antenna input point can be decreased. Therefore, the desired impedance matching between the radio frequency part and the antenna of the receiver can be very easily achieved, and the electrical property adjusting step during mass-production of the antenna can be greatly simplified.

Various embodiments of the antenna suitable for a portable receiver using a high frequency band as high as about 1.2 GHz to 1.4 GHz will now be described by reference to FIGS. 27 to 34.

Figure 27A:
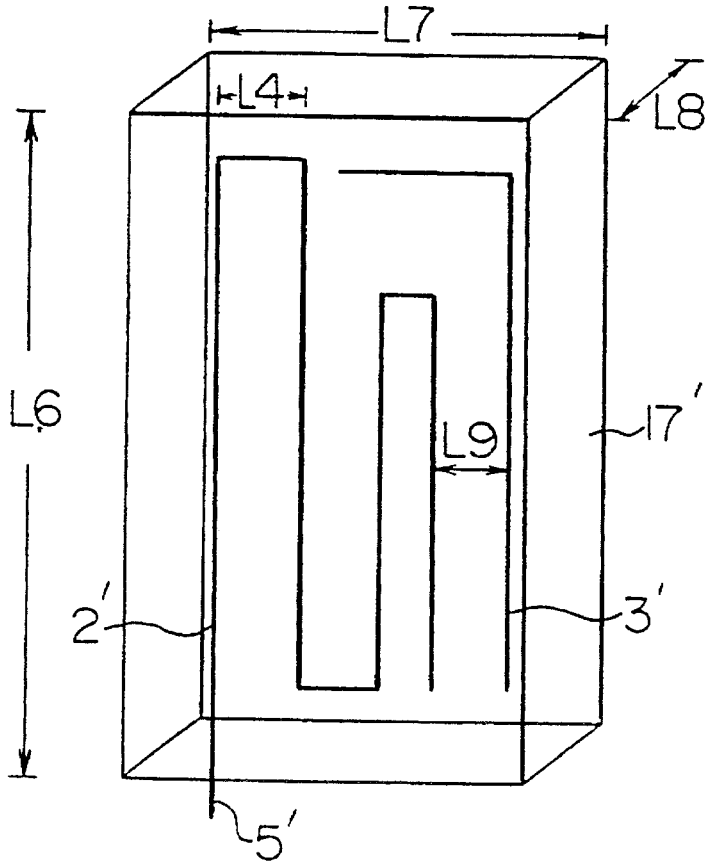
FIGS. 27A and 27B are perspective views of a twenty-second embodiment of the antenna of small size for the portable receiver according to the present invention.
Figure 27B:
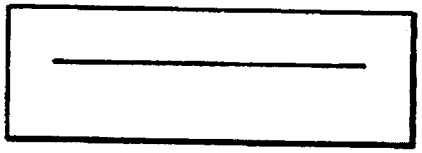

FIGS. 27A and 27B are perspective views of a twenty-second embodiment of the antenna whose size is smaller than that of the aforementioned embodiments of the present invention.

When the frequency used by a receiver is about 1.3 GHz, the required electric length (λ/4) of the antenna of the receiver is only about 58 mm so that the size of the antenna can be made further smaller.

As shown in FIG. 27A, a meander conductor 2' whose electric length is about λ/4 and which is connected to a feeding point 5' is buried in a dielectric quadratic prism or a dielectric column 17' having a rectangular cross section. The conductor 2' is bent in the form of a meander so as to maintain a distance L4 that is required to substantially nullify the adverse effect of displacement current. Further, another meander conductor 3' is disposed on the plane where the meander conductor 2' is formed. The meander conductor 3' is spaced apart from the meander conductor 2' by a distance L9 suitable for excitation by means of electromagnetic coupling.

The dimensions L6, L7 and L8 of the dielectric square column or prism 17' are L6≈50 mm, L7≈30 mm and L8≈7 mm, and this column 17' is made by bonding together two members forming the column as described later by reference to FIG. 31. The electric length of the meander conductor 2' is about λ/4 (58 mm), while the electric length of the meander conductor 3' is about 40 mm. The meander conductors 2' and 3' are formed by printing on a dielectric film whose height and width are equal to L6 and L7, respectively. The dielectric film having the meander conductors 2' and 3' printed thereon is sandwiched between the two members of the dielectric square column 17' to complete the antenna.

This twenty-second embodiment of the antenna has a very small size as compared to the cylindrical antennas shown in FIGS. 15 to 26, although the radio wave directivity deviates in the direction of from the meander conductor 2' toward to the meander conductor 3' (in the rightward direction in FIGS. 27A and 27B).

A twenty-third embodiment of the antenna of small size for the portable receiver according to the present invention will now be described by reference to FIGS. 28A and 28B.

Figure 28A:
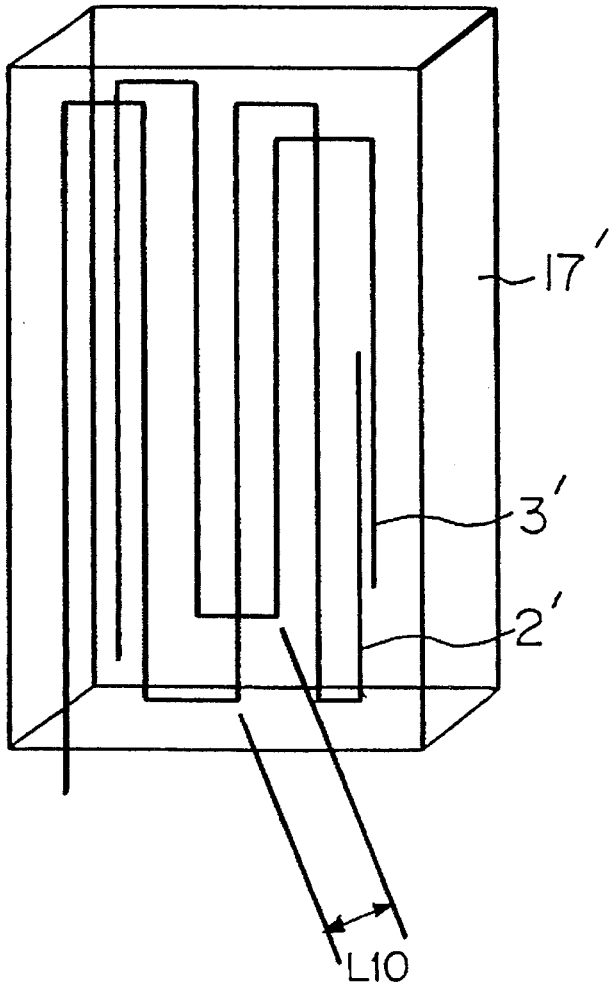
FIGS. 28A and 28B are perspective views of a twenty-third embodiment of the antenna of small size for the portable receiver according to the present invention.
Figure 28B:
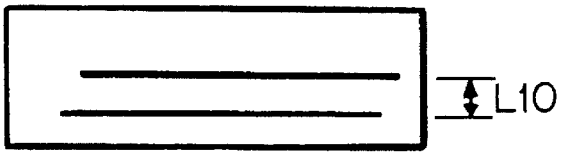

The embodiment of the antenna shown in FIGS. 28A and 28B differs from that shown in FIGS. 27A and 27B in that a meander conductor 3' disposed on one plane for producing multiple resonance together with a meander conductor 2' connected to a feeding point is disposed on another plane spaced apart by another distance L10. The distance L10 required for the meander conductors 2' and 3' for producing the multiple resonance is about 0.8 mm.

Therefore, when the meander conductors 2' and 3' for producing the multiple resonance are disposed on planes different from each other, the size of the dielectric square column 17' shown in FIG. 28A can be made further smaller as compared to the embodiment shown in FIG. 27A.

A twenty-fourth embodiment of the antenna of small size according to the present invention will now be described by reference to FIG. 29.

Figure 29:
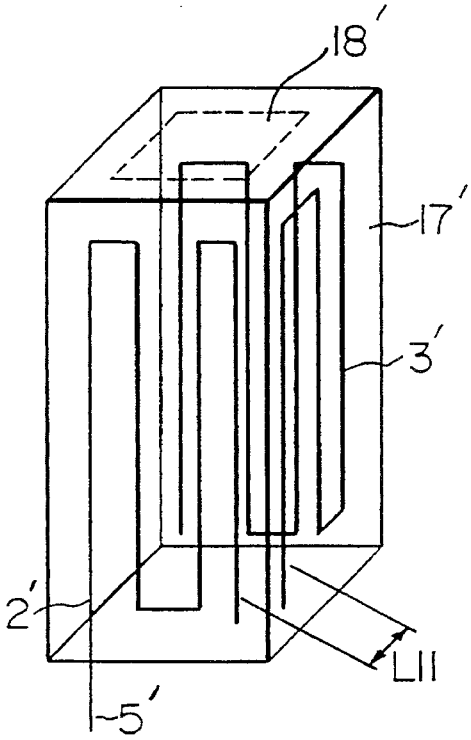
FIG. 29 is a perspective view of a twenty-fourth embodiment of the antenna of small size for the portable receiver according to the present invention.

A dielectric column or prism 17' having a square cross section shown in FIG. 29 is composed of an inner dielectric square column 18' and an output dielectric member about 0.8 mm thick surrounding the four surfaces of the inner column 18'. A meander conductor 2' and another meander conductor 3' printed on a dielectric film are wound around the inner dielectric column 18'. The meander conductor 2' is connected to a feeding point 5', while the meander conductor 3' is spaced apart from the meander conductor 2' by a distance (L11 ≈0.8 mm) required for producing multiple resonance together with the meander conductor 2'. According to this twenty-fourth embodiment, the radio wave directivity is improved as compared to the embodiment shown in FIGS. 27A and 27B.

A twenty-fifth embodiment of the antenna of small size according to the present invention will now be described by reference to FIGS. 30A and 30B.

Figure 30A:
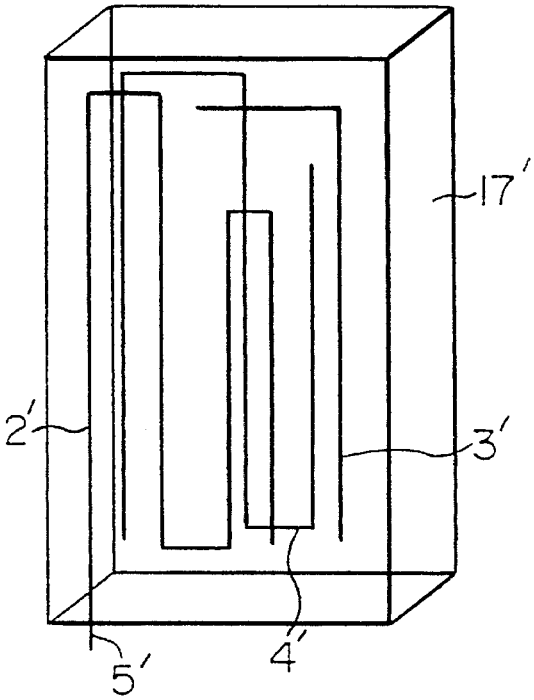
FIGS. 30A and 30B are perspective views of a twenty-fifth embodiment of the antenna of small size for the portable receiver according to the present invention.
Figure 30B:
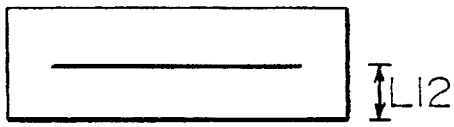

The antenna shown in FIGS. 30A and 30B is similar in its structure to that shown in FIGS. 28A and 28B. The former differs from the latter in that meander conductors 2' and 3' printed on the same dielectric film are disposed on the surface of a dielectric column 17' having a square cross section, and another meander conductor 4' having an electric length of about 50 mm is disposed in a relation spaced apart by a suitable distance (L12≈0.8 mm) from the dielectric film on which the meander conductors 2' and 3' are printed. When compared to the antenna shown in FIGS. 28A and 28B, the embodiment shown in FIGS. 30A and 30B is advantageous in that the antenna having a wider frequency band can be provided because of the increase in the number of the meander conductors producing multiple resonance.

Figure 31:
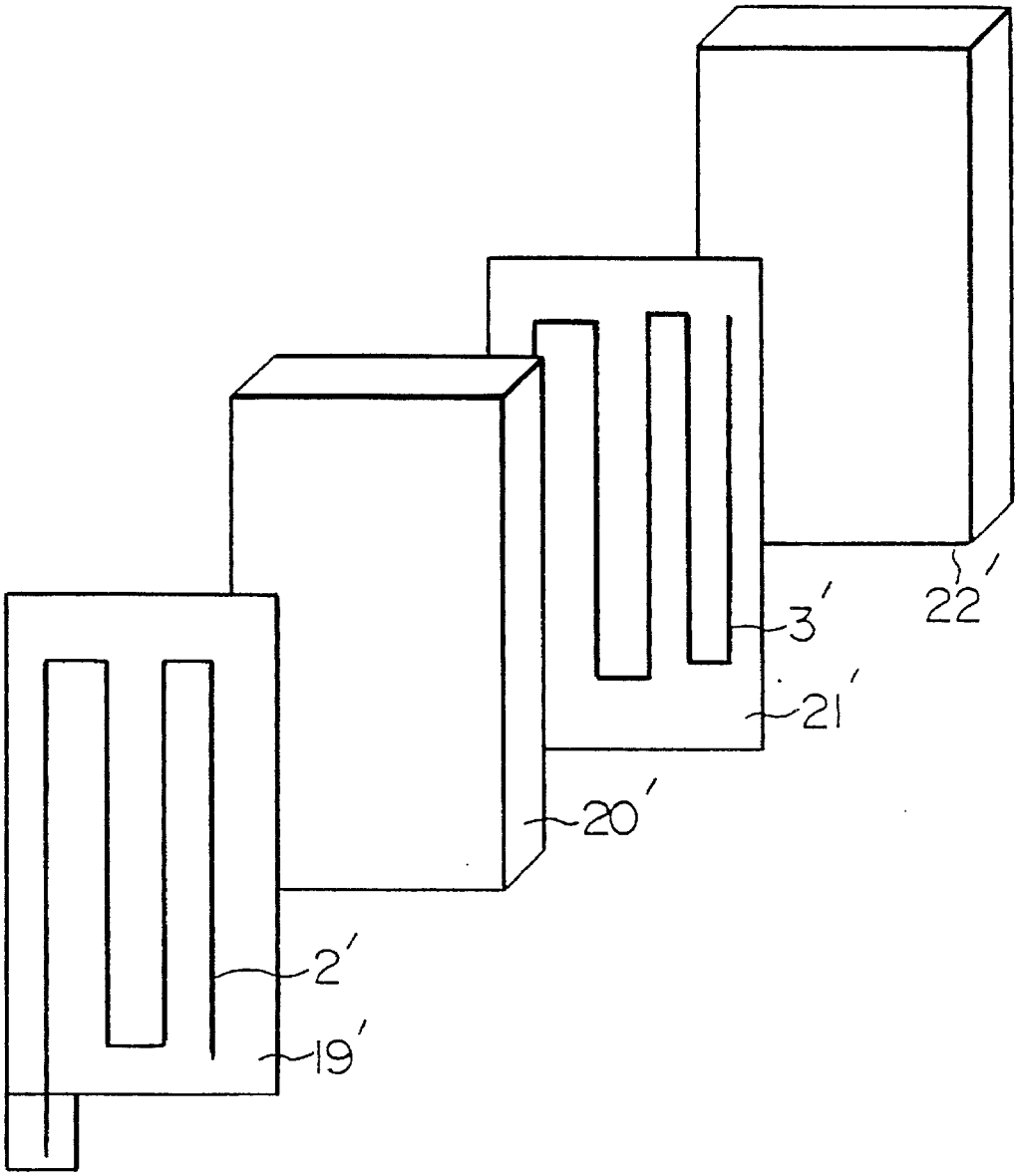
FIG. 31 is a perspective view showing the process for manufacturing the antenna of small size for the portable receiver according to the present invention.

FIG. 31 illustrates the steps for manufacturing an antenna such as that shown in FIGS. 30A and 30B. Referring to FIG. 31, a meander conductor 2' connectable to a feeding point is printed on a dielectric film 19', and another meander conductor 3' for producing multiple resonance together with the meander conductor 2' is printed on another dielectric film 21'. As shown in FIG. 31, the dielectric film 21' is sandwiched between two members 20' and 22' provided by splitting a dielectric square column or prism into halves, and the dielectric film 19' is bonded to the surface of the dielectric member 20'. It will thus be seen that the individual members of the antenna can be made at low costs and with high accuracy so that the mass productivity of the antenna can be improved. On the other hand, in accordance with another approach, the antenna may be manufactured as a unitary body. That is, instead of using dielectric films 19' and 21', meander conductors may be buried in the members 20' and 22'.

A twenty-sixth embodiment of the antenna of small size according to the present invention will now be described by reference to FIGS. 32A and 32B.

Figure 32A:
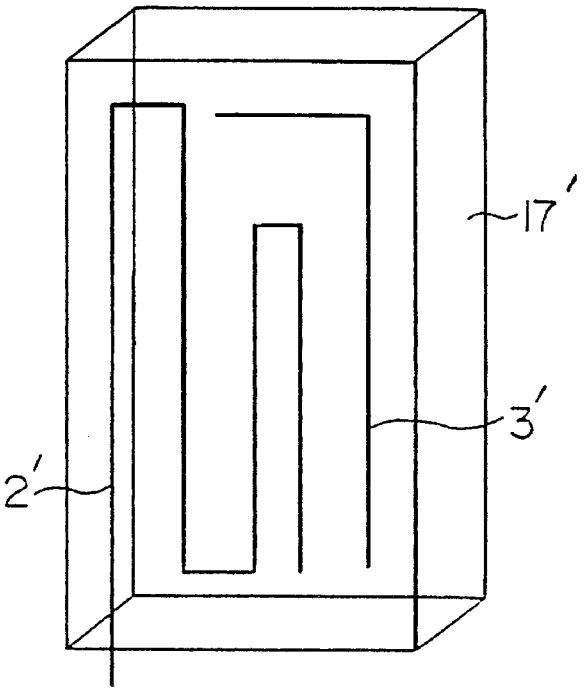
FIGS. 32A and 32B are perspective views of a twenty-sixth embodiment of the antenna of small size for the portable receiver according to the present invention.
Figure 32B:
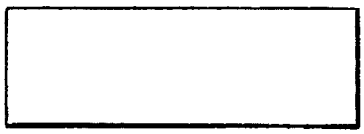

The antenna shown in FIGS. 32A and 32B differs from that shown in FIGS. 27A and 28B in that meander conductors 2' and 3' are disposed on the surface of a dielectric column 17' having a square cross section. According to this embodiment, the dielectric square column 17' need not be split into two members. Therefore, the mass productivity of the antenna can be improved.

Figure 33:
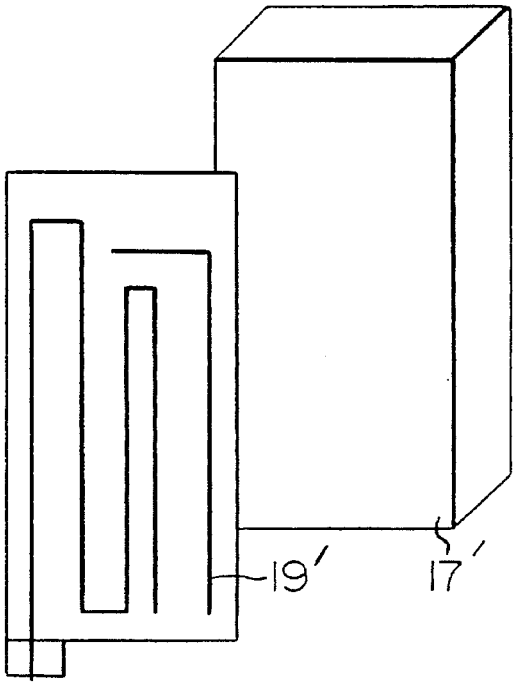
FIG. 33 is a perspective view showing the process for manufacturing the antenna of small size for the portable receiver according to the present invention.

FIG. 33 is a perspective view showing the process for manufacturing an antenna such as that shown in FIGS. 32A and 32B. A meander conductor 2' connectable to a feeding point and another meander conductor 3' for producing multiple resonance together with the meander conductor 2' are printed on a dielectric film 19'. As shown in FIG. 31, the dielectric film 19' is then bonded to the surface of the dielectric square column 17'.

Figure 34:
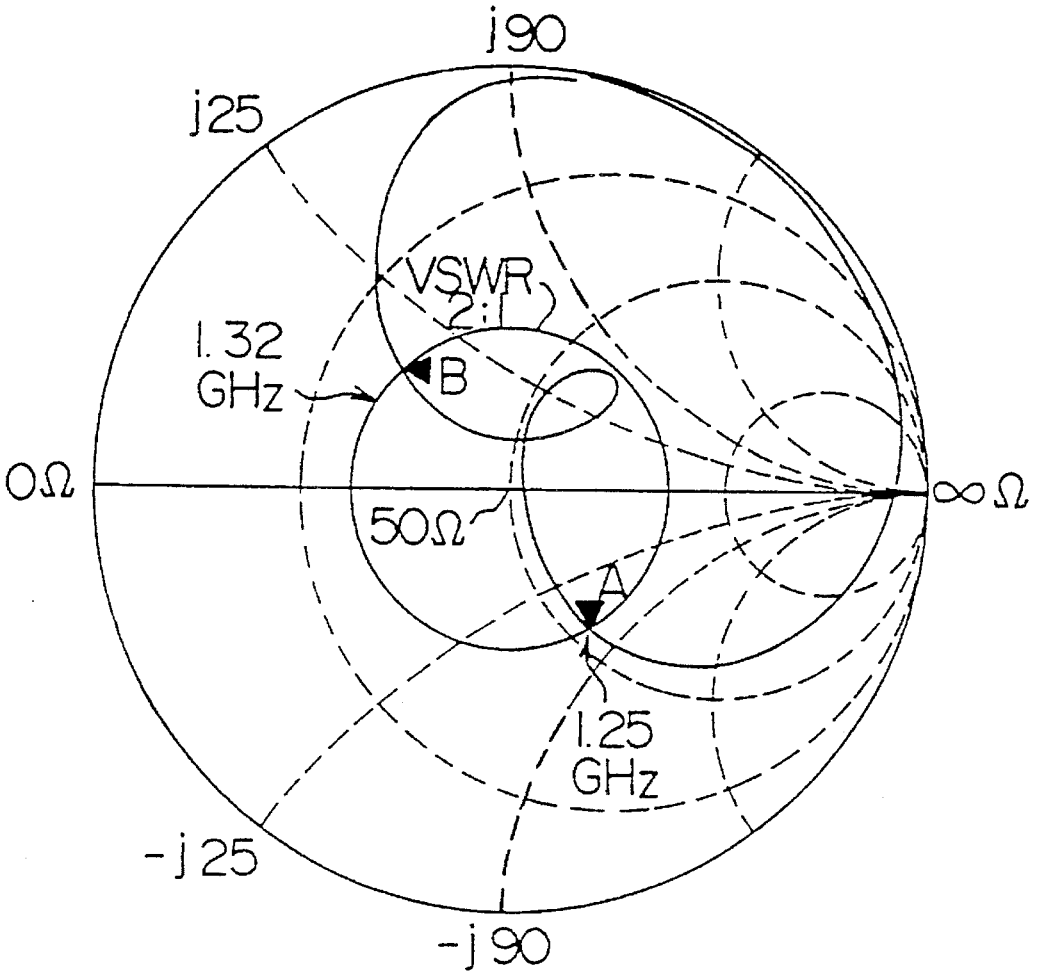
FIG. 34 is a Smith chart plot of the driving point impedance of the antenna represented by FIG. 18 of the present invention.

FIG. 34 is a Smith chart plot to illustrate how the embodiment of the antenna of small size for the portable receiver shown in FIGS. 32A and 32B has an electrical property matching with that of the radio frequency part of the receiver. It can be understood from FIG. 26 that the state of satisfactory matching where the VSWR (voltage standing wave ratio) of 2:1 is achieved in the frequency range between the points a and b.

In FIG. 34, the frequencies at the points a and b are 1.25 GHz and 1.32 GHz, respectively, and the center frequency is 1.3 GHz. Therefore, the bandwidth in the matching range is about 5%, and it can be seen that the antenna has a wide frequency band.

It will be apparent from the foregoing description of various embodiments of the present invention that the antenna that satisfies the desired good matching state with the radio frequency part of the receiver without requiring a separately provided matching circuit can be produced with high mass productivity and also with a simple adjustment step.

What is claimed is:

1. An antenna system of small size that can be mass-produced and that has a wide frequency band for use with a portable receiver, comprising:

a plurality of meander conductors printed on at least one film of a dielectric material and satisfying respectively different resonance conditions in a frequency band used by the receiver;

at least one solid cylinder of a dielectric material for winding said dielectric film therearound; and a hollow cylinder of a dielectric material for covering said dielectric film wound around said dielectric solid cylinder, wherein said individual meander conductors, which are printed on said dielectric film, do not make direct electrical contact with each other, wherein said plural meander conductors include a first meander conductor, which is used an antenna, connected to the feeder and second and third meander Conductors, which are used as resonators, spaced apart by predetermined distances from said first meander conductor, respectively, for producing multiple resonance by electromagnetic coupling with said first meander conductor, thereby widening the frequency band, wherein said first and second meander conductors are printed on a first dielectric film, while said third meander conductor is printed on a second dielectric film, wherein said dielectric solid cylinder includes an inner dielectric solid cylinder disposed at a central area of the antenna system and an inner dielectric hollow cylinder having a predetermined thickness and covering said inner dielectric solid cylinder, and wherein said second dielectric film is disposed between said inner dielectric solid cylinder and said inner dielectric hollow cylinder, while said first dielectric film is disposed to surround the outer periphery of said inner dielectric hollow cylinder.

2. An antenna system according to claim 1, wherein the electric length of said first meander conductor is selected to be about ¼ of the wavelength used by the receiver, while the electric lengths of said second and third meander conductors are selected to be ½ of respectively different wavelengths of radio waves within a frequency band used by the receiver.

3. An antenna system of small size for a portable receiver according to claim 1, wherein the dielectric constant of said inner dielectric solid cylinder is lower than the dielectric constant of said inner dielectric hollow cylinder and the dielectric constant of said dielectric hollow cylinder.

4. An antenna system of small size for a portable receiver according to claim 1, wherein the dielectric constant of a part of said inner dielectric solid cylinder spaced apart by a predetermined distance from the central axis of said inner dielectric solid cylinder is equal to the dielectric constant of air.

5. An antenna system of small size that can be mass-produced and that has a wide frequency band for use with a portable receiver, comprising:

at least one meander conductor which is used as resonator printed on at least one film of a dielectric material;

at least one solid cylinder of a dielectric material for winding said dielectric film therearound;

a hollow cylinder of a dielectric material for covering said dielectric film wound around said dielectric solid cylinder; and a helical conductor which is used as antenna wound around said dielectric hollow cylinder and connected to a feeder, wherein said meander conductor printed on said dielectric film and said helical conductor do not make direct electrical contact with each other, and said helical conductor and said meander are spaced apart from each other to produce multiple resonance by electromagnetic coupling, thereby widening the frequency band of the helical conductor.

6. An antenna system of small size for a portable receiver according to claim 5, further comprising a linear conductor connected to ground and printed on said dielectric film without making direct electrical contact with said meander conductor.

7. An antenna system of small size for a portable receiver according to claim 5, wherein said meander conductor is spaced apart from said helical conductor by a predetermined distance for producing multiple resonance by electromagnetic coupling with said helical conductor, and wherein the electric length of said helical conductor is selected to be about ¼ of the wavelength used by the receiver, while the electric length of said meander conductor is selected to be about ½ of the wavelength used by the receiver.

8. An antenna system of small size for a portable receiver according to claim 5, wherein said dielectric solid cylinder includes an inner dielectric solid cylinder disposed at the central area and an inner dielectric hollow cylinder having a predetermined thickness for covering said inner dielectric solid cylinder, a first meander conductor being printed on a first dielectric film, a second meander conductor for producing multiple resonance by electromagnetic coupling with said first meander conductor being printed on a second dielectric film, said second dielectric film being disposed between said inner dielectric solid cylinder and said inner dielectric hollow cylinder, said first dielectric film being disposed to surround the outer periphery of said inner dielectric hollow cylinder, and wherein the electric length of said helical conductor is selected to be about ¼ of the wavelength used by the receiver, while the electric lengths of each of said first and second meander conductors are selected to be about ½ of the wavelength used by the receiver.

9. An antenna system of small size for a portable receiver according to claim 8, wherein the dielectric constant of said inner dielectric solid cylinder is lower than the dielectric constant of said inner dielectric hollow cylinder and the dielectric constant of said dielectric hollow cylinder.

10. An antenna system of small size that can be mass-produced and that has a wide frequency band for use with a portable receiver, comprising:

a plurality of meander conductors printed on plural films of a dielectric material and satisfying respectively different resonance conditions in a frequency band used by the receiver; and a prism of a dielectric material having a square cross section and comprised of plural members bonded to said plural dielectric films;

wherein said individual meander conductors printed on said plural dielectric films do not make direct electrical contact with each other, wherein one of said meander conductors, which is used as an antenna is connected to a feeder acts to produce multiple resonance by electromagnetic coupling with at least one other meander conductor which is used as a resonator, thereby widening the frequency band, wherein said dielectric square prism is comprised of first, second and third dielectric members separated from one another By two parallel planes, a first meander conductor having an electric length equal to about ¼ of the wavelength used by the receiver and being printed on a first dielectric film, a second meander conductor having an electric length different from the electric length of said first meander conductor and being printed on a second dielectric film, and wherein said antenna system of small size is made by sandwiching said first dielectric film between a first dielectric member and a second dielectric member, and sandwiching said second dielectric film between said second dielectric member and a third dielectric member.

11. An antenna system of small size that can be mass-produced and that has a wide frequency band for use with a portable receiver, comprising:

a plurality of meander conductors printed on plural films of a dielectric material and satisfying respectively different resonance conditions in a frequency band used by the receiver; and a prism of a dielectric material having a square cross section and comprised of plural members bonded to said plural dielectric films, wherein said individual meander conductors printed on said plural dielectric films do not make direct electrical contact with each other, wherein one of said meander conductors which is used as an antenna is connected to a feeder acts to produce multiple resonance by electromagnetic coupling with at least one other meander conductor which is used as a resonator, thereby widening the frequency band, wherein said dielectric square prism is comprised of first and second dielectric members separated from each other by a plane parallel to at least one side of said dielectric prism, a first meander conductor having an electric length equal to about ¼ of the wavelength used by the receiver and being printed on a first dielectric film, a second meander conductor having an electric length different from the electric length of said first meander conductor and being printed on a second dielectric film, and wherein said antenna system of small size is made by bonding said first dielectric film to the side of said dielectric prism which is parallel to said plane, and sandwiching said second dielectric film between a first dielectric member and a second dielectric member.

* * * * *